US008404034B2

(12) United States Patent
Hwang et al.

(10) Patent No.: US 8,404,034 B2
(45) Date of Patent: Mar. 26, 2013

(54) VACUUM CLEANER AND METHOD OF CONTROLLING THE SAME

(75) Inventors: Man Tae Hwang, Changwon-si (KR); Hae Seock Yang, Changwon-si (KR); Hoi Kil Jeong, Changwon-si (KR); Myung Sig Yoo, Changwon-si (KR); Jae Kyum Kim, Kimhae-si (KR); Moo Hyun Ko, Moonkyung-si (KR); Kie Tak Hyun, Changwon-si (KR); Jong Su Choo, Busan-si (KR); Young Bok Son, Changwon-si (KR); Kyeong Seon Jeong, Changwon-si (KR); Min Park, Busan-si (KR); Sung Hwa Lee, Changwon-si (KR); Il Joong Kim, Masan-si (KR); Jin Hyouk Shin, Busan-si (KR); Gun Ho Ha, Busan-Si (KR); Jin Wook Seo, Busan-si (KR); Chang Ho Yun, Changwon-si (KR); Jin Young Kim, Busan-si (KR); Chang Hoon Lee, Changwon-si (KR); Yun Hee Park, Kimhae-si (KR); Hyuk-Min Kwon, Changwon (KR); Young-Gun Min, Changwon (KR)

(73) Assignee: LG Electronics Inc., Seoul (KR)

( * ) Notice: Subject to any disclaimer, the term of this patent is extended or adjusted under 35 U.S.C. 154(b) by 712 days.

(21) Appl. No.: 12/407,983

(22) Filed: Mar. 20, 2009

(65) Prior Publication Data

US 2009/0266382 A1 Oct. 29, 2009

Related U.S. Application Data

(63) Continuation-in-part of application No. 11/565,241, filed on Nov. 30, 2006, now Pat. No. 7,749,295, and a continuation-in-part of application No. 11/565,206, filed on Nov. 30, 2006, now Pat. No. 7,882,592, and a continuation-in-part of application No. PCT/KR2008/000376, filed on Jan. 21, 2008.

(30) Foreign Application Priority Data

| | | |
|---|---|---|
| Dec. 10, 2005 | (KR) | 10-2005-0121279 |
| Dec. 20, 2005 | (KR) | 10-2005-0126270 |
| Dec. 29, 2005 | (KR) | 10-2005-0134094 |
| Feb. 24, 2006 | (KR) | 10-2006-0018119 |
| Feb. 24, 2006 | (KR) | 10-2006-0018120 |
| May 3, 2006 | (KR) | 10-2006-0040106 |
| May 17, 2006 | (KR) | 10-2006-0044359 |
| May 17, 2006 | (KR) | 10-2006-0044362 |
| May 20, 2006 | (KR) | 10-2006-0045415 |
| May 20, 2006 | (KR) | 10-2006-0045416 |
| May 23, 2006 | (KR) | 10-2006-0046077 |
| Sep. 6, 2006 | (KR) | 10-2006-0085919 |
| Sep. 6, 2006 | (KR) | 10-2006-0085921 |
| Oct. 10, 2006 | (KR) | 10-2006-0098191 |
| Jul. 16, 2007 | (KR) | 10-2007-0071121 |
| Jul. 16, 2007 | (KR) | 10-2007-0071136 |
| Jul. 16, 2007 | (KR) | 10-2007-0071137 |
| Jul. 23, 2007 | (KR) | 10-2007-0073221 |

(51) Int. Cl.
*B01D 45/12* (2006.01)

(52) U.S. Cl. ..... 96/417; 55/429; 55/459.1; 55/DIG. 3; 55/428

(58) Field of Classification Search ..... 55/428, 55/429, 459.1, DIG. 3; 96/405, 417, 418, 96/419, 421

See application file for complete search history.

(56) References Cited

U.S. PATENT DOCUMENTS

| | | | | |
|---|---|---|---|---|
| 83,469 | A | 10/1868 | Crandall | |
| 2,283,836 | A | 5/1942 | White | |
| 2,714,426 | A | 8/1955 | White | 183/58 |
| 3,367,462 | A | 2/1968 | Bibbens | |
| 4,379,385 | A | 4/1983 | Reinhall | |
| 4,545,794 | A | 10/1985 | Himukai | 55/362 |
| 4,601,082 | A | 7/1986 | Kurz | |
| 4,617,034 | A | 10/1986 | Ikezaki et al. | 55/276 |
| 4,809,394 | A | 3/1989 | Suka et al. | 15/327 |

| | | | | |
|---|---|---|---|---|
| 5,033,151 | A | 7/1991 | Kraft et al. | 15/319 |
| 5,135,552 | A | 8/1992 | Weistra | |
| 5,159,738 | A | 11/1992 | Sunagawa et al. | 15/326 |
| 5,233,682 | A | 8/1993 | Abe et al. | |
| 5,251,358 | A | 10/1993 | Moro et al. | |
| 5,265,305 | A | 11/1993 | Kraft et al. | |
| 5,323,483 | A | 6/1994 | Baeg | |
| 5,542,146 | A | 8/1996 | Hoekstra et al. | |
| 6,192,550 | B1 | 2/2001 | Hamada et al. | |
| 6,460,217 | B2 | 10/2002 | Fukushima et al. | 15/346 |
| 6,625,845 | B2 | 9/2003 | Matsumoto et al. | |
| 6,689,225 | B2 | 2/2004 | Illingworth | |
| 6,694,917 | B1 | 2/2004 | Wang | |
| 6,735,816 | B2 | 5/2004 | Oh et al. | 15/353 |
| 6,757,933 | B2 | 7/2004 | Oh et al. | 15/353 |
| 6,779,229 | B2 | 8/2004 | Lee et al. | 15/329 |
| 6,782,584 | B2 | 8/2004 | Choi | 15/352 |
| 6,922,868 | B1 | 8/2005 | Jeong | |
| 7,028,369 | B2 | 4/2006 | Park et al. | 15/353 |
| 7,152,276 | B2 | 12/2006 | Jin et al. | |
| 7,351,269 | B2 | 4/2008 | Yau | 55/297 |
| 7,475,449 | B2 | 1/2009 | Lee | 15/326 |
| 7,481,868 | B2 | 1/2009 | Lee et al. | |
| 7,547,340 | B2 | 6/2009 | Park | 55/429 |
| 7,582,128 | B2 | 9/2009 | Hwang et al. | |
| 7,601,188 | B2 | 10/2009 | Hwang et al. | 55/343 |
| 7,608,123 | B2 | 10/2009 | Pineschi | 55/429 |
| 7,640,625 | B2 | 1/2010 | Oh et al. | 15/352 |
| 7,644,469 | B2 | 1/2010 | Beers et al. | 15/319 |
| 7,647,672 | B2 | 1/2010 | Nam et al. | 15/352 |
| 7,704,290 | B2 | 4/2010 | Oh | 55/295 |
| 7,749,295 | B2 | 7/2010 | Hwang et al. | 55/428 |
| 7,770,253 | B2 | 8/2010 | Ha et al. | 15/319 |
| 7,785,381 | B2 | 8/2010 | Oh et al. | 55/300 |
| 7,785,396 | B2 | 8/2010 | Hwang et al. | 95/1 |
| 7,854,782 | B2 | 12/2010 | Oh et al. | 55/429 |
| 7,958,598 | B2 | 6/2011 | Yun et al. | |
| 2001/0025395 | A1 | 10/2001 | Matsumoto et al. | 15/353 |
| 2002/0073505 | A1 | 6/2002 | Bolden | |
| 2002/0088079 | A1 | 7/2002 | Oh | |
| 2002/0124538 | A1 | 9/2002 | Oh et al. | |
| 2004/0211025 | A1 | 10/2004 | Jung et al. | |
| 2004/0261216 | A1 | 12/2004 | Choi et al. | 15/352 |
| 2005/0091787 | A1 | 5/2005 | Bair et al. | |
| 2005/0138763 | A1 | 6/2005 | Tanner et al. | |
| 2005/0172584 | A1 | 8/2005 | Oh et al. | |
| 2005/0252179 | A1 | 11/2005 | Oh et al. | |
| 2006/0123750 | A1 | 6/2006 | Lee et al. | 55/428 |
| 2006/0230722 | A1 | 10/2006 | Oh et al. | |
| 2007/0136980 | A1 | 6/2007 | Fujiwara et al. | |
| 2007/0143953 | A1 | 6/2007 | Hwang et al. | |
| 2007/0209149 | A1 | 9/2007 | Lee | 15/352 |
| 2007/0209339 | A1 | 9/2007 | Conrad | |
| 2008/0023035 | A1 | 1/2008 | Ha et al. | 134/18 |
| 2008/0023036 | A1 | 1/2008 | Ha et al. | 134/21 |
| 2008/0047094 | A1 | 2/2008 | Ha et al. | |
| 2008/0052870 | A1 | 3/2008 | Lee et al. | |
| 2008/0172824 | A1 | 7/2008 | Yun et al. | 15/352 |
| 2008/0172993 | A1 | 7/2008 | Yun et al. | 55/337 |
| 2008/0263816 | A1 | 10/2008 | Oh et al. | 15/347 |
| 2008/0264007 | A1 | 10/2008 | Oh et al. | 55/304 |
| 2008/0264014 | A1 | 10/2008 | Oh et al. | 55/423 |
| 2008/0264015 | A1 | 10/2008 | Oh et al. | 55/429 |
| 2008/0264016 | A1 | 10/2008 | Oh et al. | 55/429 |
| 2009/0178231 | A1 | 7/2009 | Hwang et al. | 15/347 |
| 2009/0178235 | A1 | 7/2009 | Yun et al. | 15/352 |
| 2009/0178236 | A1 | 7/2009 | Yun et al. | 15/352 |
| 2009/0229072 | A1 | 9/2009 | Hwang et al. | 15/352 |
| 2009/0229073 | A1 | 9/2009 | Hwang et al. | 15/352 |
| 2009/0235956 | A1 | 9/2009 | Hwang et al. | 134/21 |
| 2009/0241286 | A1 | 10/2009 | Hwang et al. | 15/347 |
| 2009/0249578 | A1 | 10/2009 | Hwang et al. | 15/352 |
| 2009/0255083 | A1 | 10/2009 | Hwang et al. | 15/347 |
| 2009/0266382 | A1 | 10/2009 | Hwang et al. | 134/21 |
| 2009/0293221 | A1 | 12/2009 | Hwang et al. | 15/347 |
| 2009/0293223 | A1 | 12/2009 | Hwang et al. | 15/352 |
| 2009/0293224 | A1 | 12/2009 | Hyun et al. | 15/353 |
| 2009/0293915 | A1 | 12/2009 | Hwang et al. | 134/21 |

FOREIGN PATENT DOCUMENTS

| | | | |
|---|---|---|---|
| AU | 2005229774 | | 8/2006 |
| AU | 2007200406 | B2 | 9/2007 |
| CN | 2162679 | | 4/1994 |
| CN | 2186039 | | 12/1994 |
| CN | 2409894 | | 12/2000 |
| CN | 1334061 | | 2/2002 |
| CN | 1434749 | A | 8/2003 |
| CN | 1593324 | | 3/2005 |
| CN | 1695537 | | 11/2005 |
| CN | 1695538 | | 11/2005 |
| CN | 1777385 | | 5/2006 |
| CN | 1778246 | | 5/2006 |
| DE | 102 40 618 | | 9/2003 |
| EP | 1 371 318 | A2 | 12/2003 |
| EP | 1 671 569 | | 6/2006 |
| EP | 1 671 570 | | 6/2006 |
| EP | 01 136 028 | | 7/2006 |
| EP | 1 733 669 | | 12/2006 |
| EP | 1857032 | | 11/2007 |
| FR | 2 823 091 | | 10/2002 |
| GB | 2 368 516 | | 5/2002 |
| GB | 2 377 881 | | 1/2003 |
| GB | 2 388 769 | | 4/2004 |
| GB | 2404887 | | 2/2005 |
| GB | 2 406 064 | | 3/2005 |
| GB | 2416721 | | 2/2006 |
| GB | 2466625 | | 6/2010 |
| JP | 1972-14759 | | 8/1972 |
| JP | 50-022355 | | 3/1975 |
| JP | 53-051663 | | 5/1978 |
| JP | 54-28457 | | 3/1979 |
| JP | 54-51259 | | 4/1979 |
| JP | 54-085560 | | 7/1979 |
| JP | 54-085561 | | 7/1979 |
| JP | 54-119272 | | 8/1979 |
| JP | 54-114358 | | 9/1979 |
| JP | 54-114366 | | 9/1979 |
| JP | 54-114367 | | 9/1979 |
| JP | 54161751 | | 12/1979 |
| JP | 55-74553 | | 6/1980 |
| JP | 56-26044 | | 3/1981 |
| JP | 58-84066 | A | 5/1983 |
| JP | 58-175532 | | 10/1983 |
| JP | 58-218934 | | 12/1983 |
| JP | 59-125354 | | 8/1984 |
| JP | 64-029246 | | 1/1989 |
| JP | 02-007927 | | 1/1990 |
| JP | 4-116933 | U | 10/1992 |
| JP | 06-054778 | | 3/1994 |
| JP | 7-241265 | | 9/1995 |
| JP | 07-313412 | | 12/1995 |
| JP | 408000514 | | 1/1996 |
| JP | 08-112223 | A | 5/1996 |
| JP | 08-140907 | | 6/1996 |
| JP | 10-243900 | | 9/1998 |
| JP | 11-004789 | | 1/1999 |
| JP | 2000-262449 | | 9/2000 |
| JP | 2002-143060 | | 5/2002 |
| JP | 2002-187336 | | 7/2002 |
| JP | 2002-360474 | | 12/2002 |
| JP | 2003-019097 | | 1/2003 |
| JP | 2003-119575 | | 4/2003 |
| JP | 2003-125995 | | 5/2003 |
| JP | 2003-190056 | A | 7/2003 |
| JP | 2003-199695 | | 7/2003 |
| JP | 2003-310502 | | 11/2003 |
| JP | 2003-310506 | A | 11/2003 |
| JP | 2004-065357 | | 3/2004 |
| JP | 2004-528087 | A | 9/2004 |
| JP | 2004-528876 | | 9/2004 |
| JP | 2005-34213 | | 2/2005 |
| JP | 2005-324002 | | 11/2005 |
| JP | 06-061439 | | 3/2006 |
| JP | 2006-068500 | | 3/2006 |
| JP | 3119575 | | 3/2006 |
| JP | 2006340972 | A * | 12/2006 |
| JP | 2007-007381 | A | 1/2007 |
| JP | 2008-73066 | | 4/2008 |

| | | | |
|---|---|---|---|
| JP | 2003-524522 | | 8/2008 |
| KR | 1993-0008369 | | 8/1993 |
| KR | 2002-0091510 | | 12/2002 |
| KR | 10-2005-0005611 | | 1/2005 |
| KR | 10-2005-013694 | | 2/2005 |
| KR | 10-0546629 | B1 | 1/2006 |
| KR | 10-0553042 | B1 | 2/2006 |
| KR | 10-2006-031442 | | 4/2006 |
| KR | 2006-0116992 | | 11/2006 |
| KR | 10-0730956 | | 6/2007 |
| KR | 10-2007-084834 | | 8/2007 |
| KR | 10-2007-088022 | | 8/2007 |
| KR | 10-0800188 | | 1/2008 |
| KR | 10-0800189 | | 1/2008 |
| KR | 10-0838886 | | 6/2008 |
| KR | 10-0838887 | | 6/2008 |
| RU | 2172132 | | 8/2001 |
| RU | 2 243 714 | | 1/2005 |
| RU | 2 269 919 | | 9/2005 |
| SU | 1326236 | | 7/1987 |
| WO | WO 00/74548 | | 12/2000 |
| WO | WO/01/35809 | | 5/2001 |
| WO | WO 01/60524 | | 8/2001 |
| WO | WO 2004/064591 | | 8/2004 |
| WO | WO2005099545 | | 10/2005 |

OTHER PUBLICATIONS

Russian Office Action dated Oct. 4, 2007 (2007103555) (translation).
Russian Office Action dated Oct. 12, 2007 (2007103557).
Korean Office Action dated Mar. 25, 2008 (016285635).
Australian Office Action dated Apr. 15, 2008 (2007200407).
Australian Office Action dated Apr. 24, 2008 (2007200409).
European Office Action dated May 8, 2008 (07101388.2-2316).
Korean Office Action dated Sep. 30, 2008 (050567614).
Chinese Office Action dated Dec. 12, 2008 (200710002992.1) (translation).
U.S. Office Action dated May 13, 2009 (U.S. Appl. No. 11/965,133).
Chinese Office Action dated May 22, 2009 (200710002992.1) (translation).
Japanese Office Action dated Jul. 28, 2009 (2007-066748).
Chinese Office Action dated Aug. 21, 2009 (200710002991.7) (translation).
U.S. Office Action dated Sep. 10, 2009 (U.S. Appl. No. 11/565,241).
U.S. Office Action dated Oct. 6, 2009 (U.S. Appl. No. 12/406,803).
European Search Report dated Oct. 15, 2009. (0162556.0-2316).
Japanese Office Action dated Nov. 4, 2009. (2007-019770).
Chinese Office Action dated Nov. 13, 2009 (200710085701.X) (translation).
Canadian Office Action dated Nov. 18, 2009 (2) (50514-26) (50514-27).
Japanese Office Action dated Nov. 25, 2009 (2007-019861).
Chinese Office Action dated Dec. 11, 2009 (200710002992.1).
Notice of Allowance dated Jan. 13, 2010 (U.S. Appl. No. 11/965,133).
Notice of Allowance dated Feb. 19, 2010 (U.S. Appl. No. 11/565,241).
Notice of Allowance dated Feb. 24, 2010 (U.S. Appl. No. 11/831,564).
U.S. Office Action issued in U.S. Appl. No. 12/406,779 dated Feb. 3, 2011.
U.S. Office Action issued in U.S. Appl. No. 11/831,473 dated Feb. 4, 2011.
U.S. Office Action issued in U.S. Appl. No. 12/408,066 dated Feb. 10, 2011.
U.S. Office Action issued in U.S. Appl. No. 12/710,585 dated Feb. 10, 2011.
U.S. Office Action issued in U.S. Appl. No. 12/404,739 dated Feb. 18, 2011.
U.S. Office Action issued in U.S. Appl. No. 12/404,692 dated Mar. 9, 2011.
U.S. Office Action issued in U.S. Appl. No. 12/404,715 dated Mar. 9, 2011.
U.S. Notice of Allowance issued in U.S. Appl. No. 12/408,066 dated Mar. 21, 2011.
U.S. Notice of Allowance issued in U.S. Appl. No. 12/407,224 dated Mar. 28, 2011.
Japanese Office Action dated Jan. 4, 2011. (Application No. 2006-333685).
European Search Report dated Jan. 27, 2011. (Application No. 06125798.6-2316/1852048).
Russian Office Action dated Feb. 2, 2011 (Application No. 2009143355) (with translation).
European Search Report dated Jan. 20, 2010.
Chinese Office Action dated Feb. 5, 2010. (with translation).
U.S. Appl. No. 11/965,133 Notice of Allowance dated Jan. 13, 2010.
U.S. Appl. No. 11/565,241 Notice of Allowance dated Feb. 19, 2010.
U.S. Appl. No. 11/831,564 Notice of Allowance dated Feb. 24, 2010.
Korean Office Action dated Mar. 18, 2010.
Korean Office Action dated Mar. 25, 2010.
U.S. Office Action U.S. Appl. No. 11/565,206 dated Apr. 19, 2010.
U.S. Notice of Allowance U.S. Appl. No. 11/831,519 dated Apr. 21, 2010.
Japanese Office Action dated May 13, 2010.
U.S. Office Action U.S. Appl. No. 11/831,473 dated May 14, 2010.
U.S. Office Action U.S. Appl. No. 12/406,803 dated May 26, 2010.
U.S. Office Action U.S. Appl. No. 11/965,133 dated Jul. 9, 2010.
Canadian Office Action dated Jun. 30, 2010.
U.S. Office Action U.S. Appl. No. 12/408,066 dated Jul. 23, 2010.
Japanese Office Action dated Aug. 3, 2010.
U.S. Office Action U.S. Appl. No. 12/406,779 dated Aug. 18, 2010.
U.S. Office Action U.S. Appl. No. 11/831,473 dated Sep. 1, 2010.
Russian Office Action dated Sep. 28, 2007 issued in Application No. 2007103559 (translation only).
Australian Office Action dated Apr. 17, 2008 issued in Application No. 2007200408.
Russian Office Action dated Apr. 21, 2008 issued in Application No. 2007103560 (with translation).
Australian Office Action dated Jun. 3, 2008 issued in Application No. 2006249267.
Japanese Office Action dated Nov. 6, 2008 issued in Application No. 2006-333685.
Russian Office Action dated Mar. 25, 2009 issued in Application No. 2008102660 (with translation).
Australian Office Action dated Apr. 16, 2009 issued in Application No. 2008200340.
Chinese Office Action dated Aug. 21, 2009 issued in Application No. 200810008716.0 (with translation).
Japanese Office Action dated Nov. 25, 2009 issued in Application No. 2007-021083.
Japanese Office Action dated Nov. 25, 2009 issued in Application No. 2007-066748.
Korean Office Action dated Aug. 29, 2008.
Japanese Office Action dated Sep. 18, 2008.
International Search Report and Written Opinion dated Dec. 10, 2008.
Japanese Office Action dated Dec. 24, 2008.
Chinese Office Action dated Feb. 6, 2009.
Japanese Office Action dated Mar. 12, 2009.
Japanese Office Action dated Mar. 13, 2009.
Chinese Office Action dated Apr. 3, 2009 (translation).
Chinese Office Action dated May 8, 2009 (translation).
Japanese Office Action dated May 22, 2009.
Chinese Office Action dated Jun. 5, 2009 (translation).
European Search Report dated Jun. 16, 2009 (in English).
Korean Office Action dated Jun. 19, 2009.
Chinese Office Action dated Jul. 3, 2009 (with translation).
Japanese Office Action dated Jul. 28, 2009 (with translation).
U.S. Office Action dated Feb. 11, 2008 (U.S. Appl. No. 11/831,473).
U.S. Office Action dated Feb. 11, 2008 (U.S. Appl. No. 11/831,564).
U.S. Office Action dated Jul. 24, 2008 (U.S. Appl. No. 11/831,473).
U.S. Office Action dated Jul. 28, 2008 (U.S. Appl. No. 11/712,958).
U.S. Office Action dated Aug. 28, 2008 (U.S. Appl. No. 11/713,022).
U.S. Office Action dated Sep. 19, 2008 (U.S. Appl. No. 11/831,564).
U.S. Office Action dated Oct. 20, 2008 (U.S. Appl. No. 11/831,473).
U.S. Office Action dated Mar. 9, 2009 (U.S. Appl. No. 11/713,022).
U.S. Office Action dated May 28, 2009 (U.S. Appl. No. 11/831,473).
U.S. Office Action dated Sep. 3, 2009 (U.S. Appl. No. 11/831,564).

Korean Office Action dated Sep. 17, 2010 issued in Application No. 10-2008-0065806.
U.S. Office Action dated Nov. 3, 2010 issued in U.S. Appl. No. 12/710,585.
U.S. Final Office Action dated Nov. 8, 2010 issued in U.S. Appl. No. 12/406,803.
U.S. Office Action dated Nov. 12, 2010 issued in U.S. Appl. No. 12/704,933.
Japanese Office Action dated Apr. 7, 2011. (2010-005365).
Russian Office Action dated Oct. 19, 2010 issued in Application No. 2009143355 (with English translation).
Chinese Office Action dated Oct. 27, 2010 issued in Application No. 200610168848.0 (with English translation).
Chinese Office Action dated Nov. 9, 2010 issued in Application No. 200610169333.2 (with English translation).
U.S. Notice of Allowance dated Jan. 12, 2011 issued in U.S. Appl. No. 11/965,133.
U.S. Notice of Allowance issued in U.S. Appl. No. 12/407,293 dated Jun. 29, 2011.
U.S. Office Action issued in U.S. Appl. No. 12/407,243 dated Jul. 18, 2011.
U.S. Office Action issued in U.S. Appl. No. 12/404,715 dated Jul. 22, 2011.
U.S. Office Action issued in U.S. Appl. No. 12/404,692 dated Jul. 20, 2011.
U.S. Office Action issued in U.S. Appl. No. 12/407,975 dated Jul. 28, 2011.
U.S. Office Action issued in U.S. Appl. No. 12/407,243 dated Nov. 16, 2011.
U.S. Office Action issued in U.S. Appl. No. 12/404,692 dated Dec. 7, 2011.
U.S. Office Action issued in U.S. Appl. No. 12/404,715 dated Dec. 8, 2011.

* cited by examiner

*Primary Examiner* — Robert A Hopkins
(74) *Attorney, Agent, or Firm* — KED & Associates LLP

(57) ABSTRACT

A vacuum cleaner and a method of controlling the vacuum cleaner are provided. The vacuum cleaner may include a main body, a dust collection device mounted in the main body, at least one compression member that compresses the dust in the dust collection device, and a driver that drives the compressing member.

20 Claims, 29 Drawing Sheets

VACUUM CLEANER AND METHOD OF CONTROLLING THE SAME

This application is a Continuation in Part of 1) U.S. patent application Ser. No. 11/565,241, filed Nov. 30, 2006, which is a Continuation in Part of U.S. patent application Ser. No. 11/565,206, filed Nov. 30, 2006, which claims priority to Korean Patent Application Nos. 2005-0121279 filed in Korea on Dec. 20, 2005, 2005-0126270 filed in Korea on Dec. 20, 2005, 2005-0134094 filed in Korea on Dec. 29, 2005, 2006-0018119 filed in Korea on Feb. 24, 2006, 2006-0018120 filed in Korea on Feb. 24, 2006, 2006-0040106 filed in Korea on May 3, 2006, 2006-0045415 filed in Korea on May 20, 2006, 2006-0045416 fled in Korea on May 20, 2006, 2006-0046077 filed in Korea on May 23, 2006, 2006-0044359 filed in Korean on May 17, 2006, 2006-0044362 filed in Korea on May 17, 2006, 2006-0085919 filed in Korea on Sep. 6, 2006, 2006-0085921 filed in Korea on Sep. 6, 2006, 2006-0085921 filed in Korea on Sep. 6, 2006, and 2006-0098191 filed in Korea on Oct. 10, 2006 and 2) PCT application No. PCT/KR2008/000376, filed Jan. 21, 2008, which claims priority to Korean Patent Application No(s). 10-2007-0071121, 10-2007-0071136, and 10-2007-0071137 filed in Korea on Jul. 16, 2007, and 10-2007-0073221 filed in Korea on Jul. 23, 2007.

BACKGROUND

1. Field

A vacuum cleaner and a method of controlling the same are disclosed herein.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
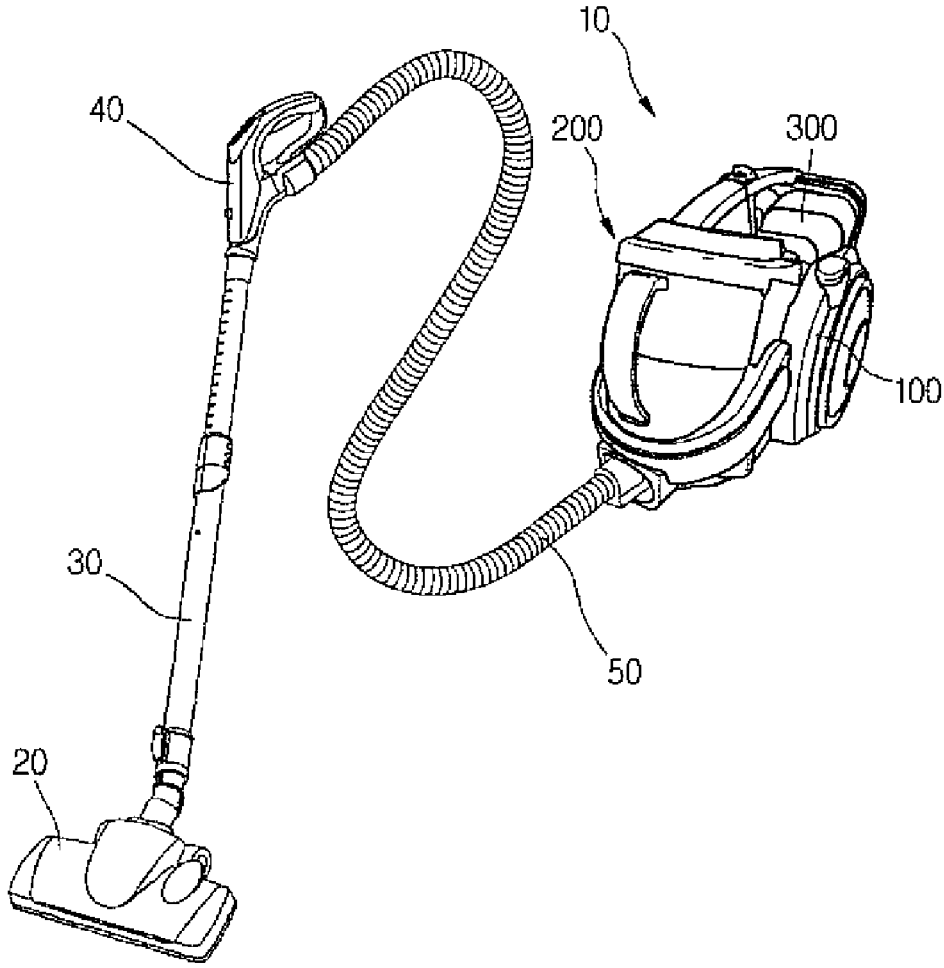
FIG. 1 is a front, perspective view of a vacuum cleaner according to an embodiment.

Reference will now be made in detail to embodiments, examples of which are illustrated in the accompanying drawings. Where possible, like reference numerals have been used to indicate like elements.

Generally, a vacuum cleaner is an electrically powered cleaning device that sucks air containing dust into a main body using suction generated by a suction motor and filters off the dust in the main body. The vacuum cleaner may include a suction nozzle that sucks in air containing the dust, a main body connected to the suction nozzle, an extension pipe that directs the air sucked in by the suction nozzle toward the main body, and a connection pipe that directs the air passing through the extension pipe to the main body.

A dust collection device that separates and stores the dust may be detachably mounted in the main body. The dust collection device may function to separate the dust contained in the air suctioned by the suction nozzle and store the separated dust. When the vacuum cleaner stops operating during the dust separation process in the dust collection device, the separated dust may be stored in the dust collection device in a relatively low density state.

According to related art dust collection devices, a volume of dust stored in the dust collection device is too big in comparison to a weight of the dust. Therefore, the dust collection device must be frequently emptied in order to maintain a proper dust collection performance. This is troublesome for the user. In order to improve user convenience of the vacuum cleaner, a vacuum cleaner that can maximize the dust collection volume and improve the dust collection performance has been recently developed.

Figure 2:
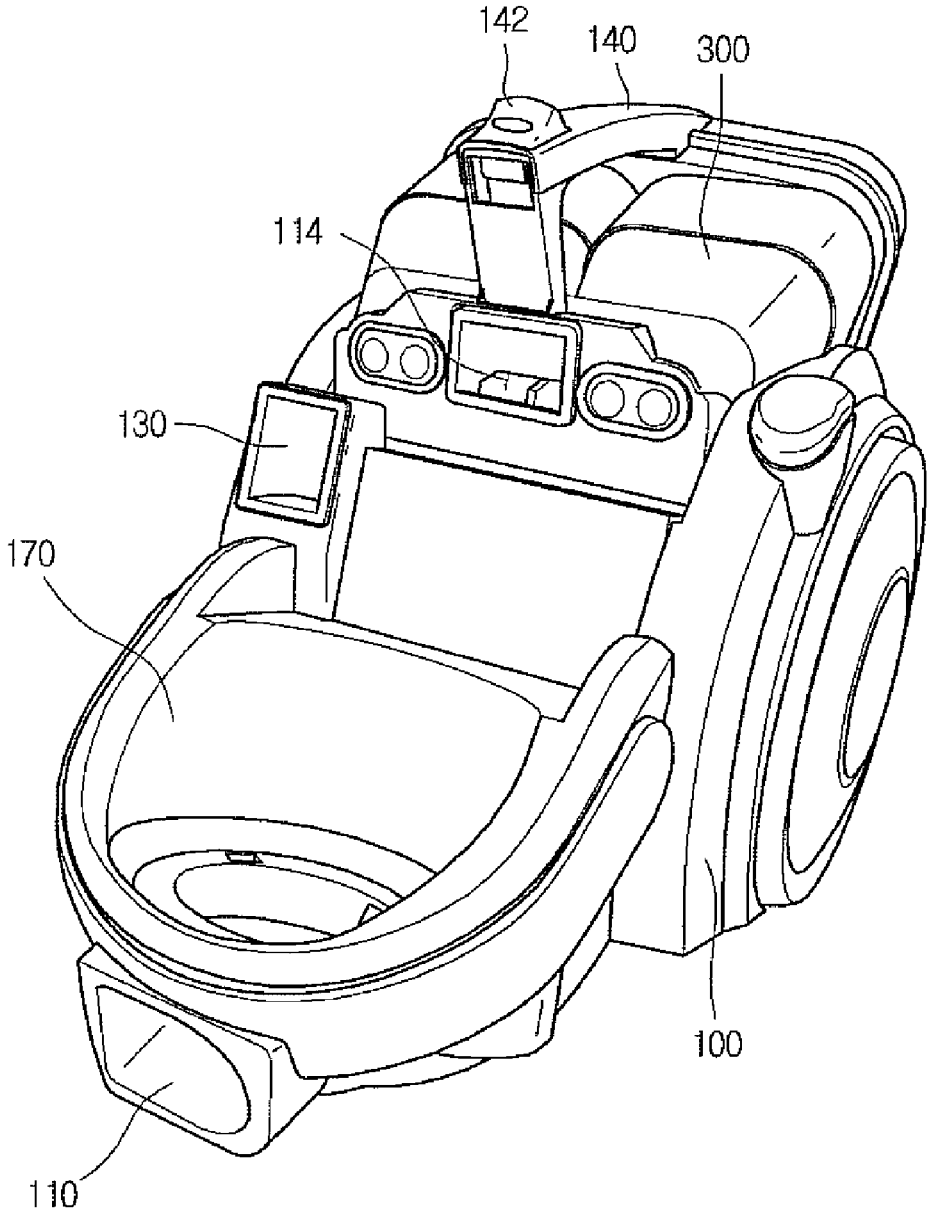
FIG. 2 is a front, perspective view of the vacuum cleaner of FIG. 1, when a dust collection device is separated therefrom.
Figure 3:
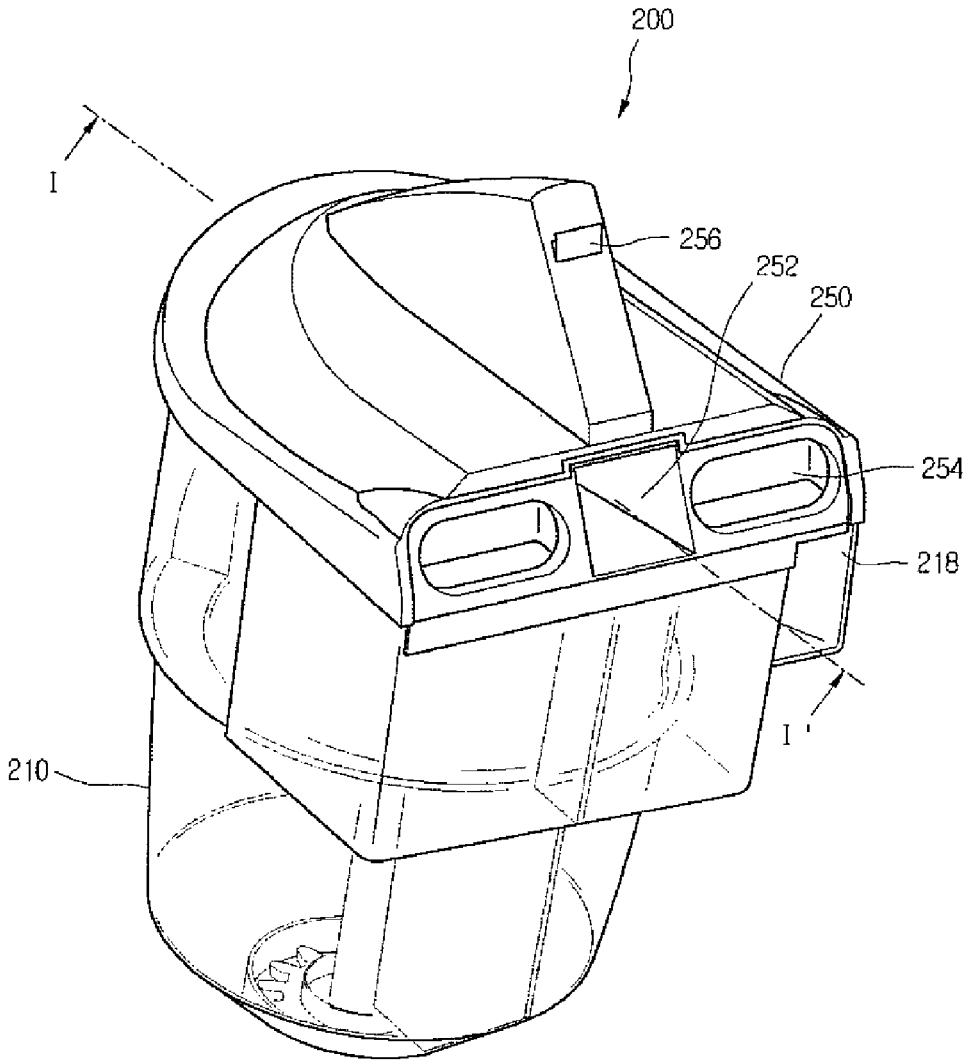
FIG. 3 is a rear, perspective view of a dust collection device of the vacuum cleaner of FIG. 1.

FIG. 1 is a front, perspective view of a vacuum cleaner according to an embodiment. FIG. 2 is a front, perspective view of the vacuum cleaner of FIG. 1, when a dust collection device is separated therefrom. FIG. 3 is a rear, perspective view of a dust collection device of the vacuum cleaner of FIG. 1.

Referring to FIGS. 1 through 3, a vacuum cleaner 10 of this embodiment may include a main body 100, in which a suction motor (not shown) that generates a suction force may be provided and a dust separating device that separates dust from the air. The vacuum cleaner 10 may further include a suction nozzle 20 that sucks in air containing dust, a handle 40 for manipulating the vacuum cleaner 10, an extension pipe 30 that connects the suction nozzle 20 to the handle 40, and a connection hose that connects the suction nozzle 20 to the main body 100. Since structures of the suction nozzle 20, extension pipe 30, and connection hose 50 are well known in the art, detailed descriptions thereof have been omitted herein.

A main body inlet 110, through which air containing the dust sucked in through the suction nozzle 20 may be introduced, may be formed on a front-lower end of the main body 100. An outlet (not shown), through which the air from which the dust is separated may be discharged to an external side, may be formed on a side of the main body 100. A main body handle device 140 may be formed on a top of the main body 100.

The dust separation device may include a dust collection device 200 having a first cyclone device 230, which will be described later, that primarily separates the dust from the air, and a second cyclone device 300 that further separates the dust from the air from which the dust is primarily separated by the first cyclone device. The second cyclone device 300 may be provided in the main body 100.

The dust collection device 200 may be detachably mounted on a dust collection device mounting portion 170 formed on a front portion of the main body 100. A mounting/dismounting lever 142 may be provided on the handle device 140 of the main body 100, and the dust collection device 200 may be provided with a hook step 256 that may be selectively engaged with the mounting/dismounting lever 142. The dust collection device 200 may include the first cyclone device 230 that generates cyclone flow and a dust collection body 210, in which the dust separated by the first cyclone device 230 may be stored.

As the dust collection device 200 is mounted on the main body 100, the dust collection device 200 may communicate with the main body 100 and the second cyclone device 300. The main body 100 may be provided with an air outlet 130, through which the air sucked into the main body 100 may be discharged, and the dust collection device 200 may be provided with a first air inlet 218, through which the air discharged through the air outlet 130 may be introduced.

The dust collection device 200 may be further provided with a first air outlet 252, through which the air from which the dust is separated in the first cyclone device 230 passes. The main body 100 may be provided with a connection passage 114, along which the air discharged through the first air outlet 252 may be introduced. The air introduced along the connection passage 114 may be directed to the second cyclone device 300.

The dust separated in the second cyclone device 300 may be stored in the dust collection device 200. Therefore, the dust collection body 210 may be provided with a dust inlet 254, through which the dust separated in the second cyclone device 300 may be introduced, and a dust storing device, in which the dust separated in the second cyclone device 300 may be stored.

The vacuum cleaner of this embodiment may further include a compression structure that compresses the dust to maximize an amount of the dust stored in the dust collection device 200. The following will describe the vacuum cleaner having the dust collection device that maximizes a dust collection amount.

Figure 4A:
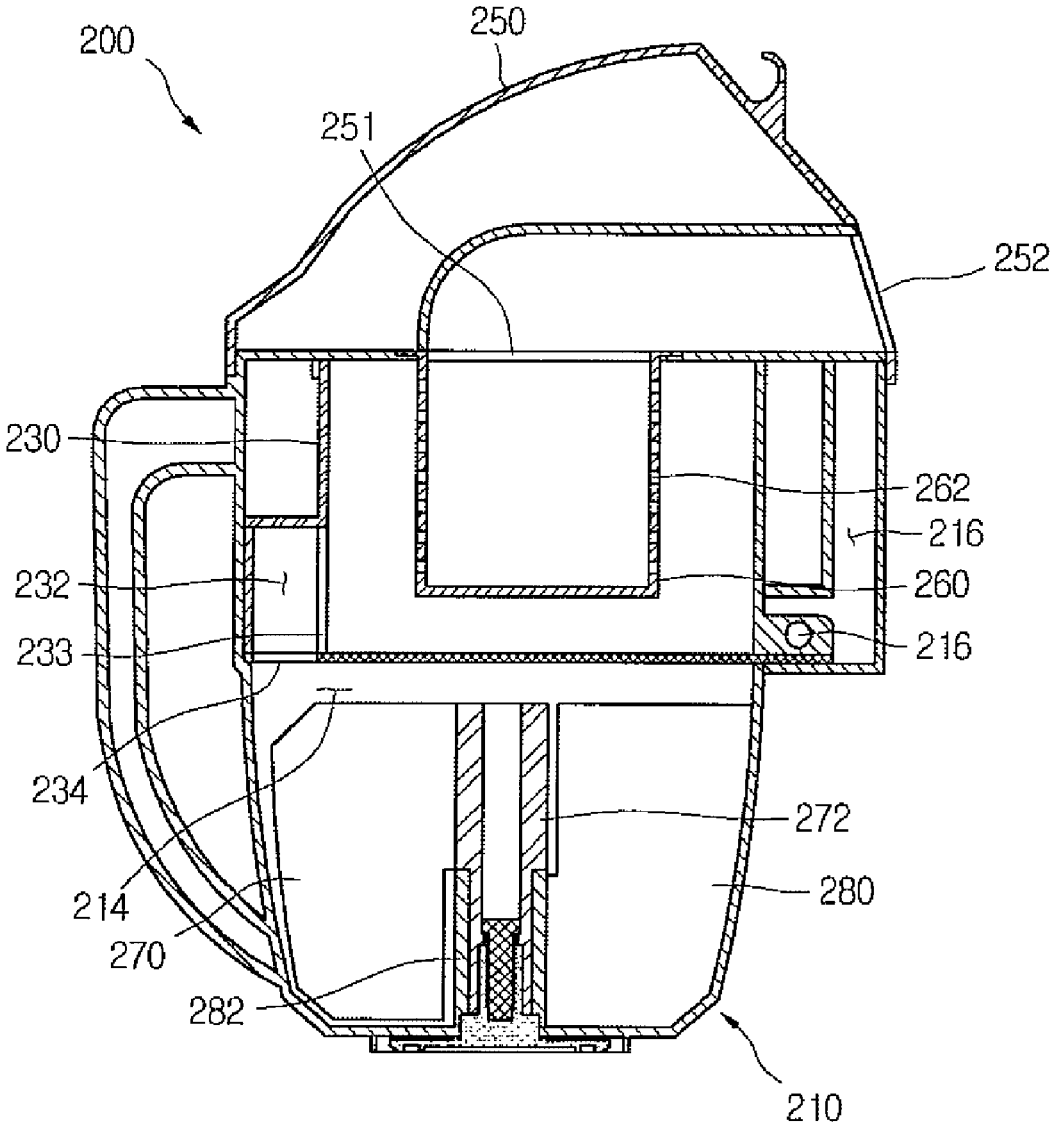
FIGS. 4A-4B are sectional views taken along line I-I' of FIG. 3.
Figure 4B:
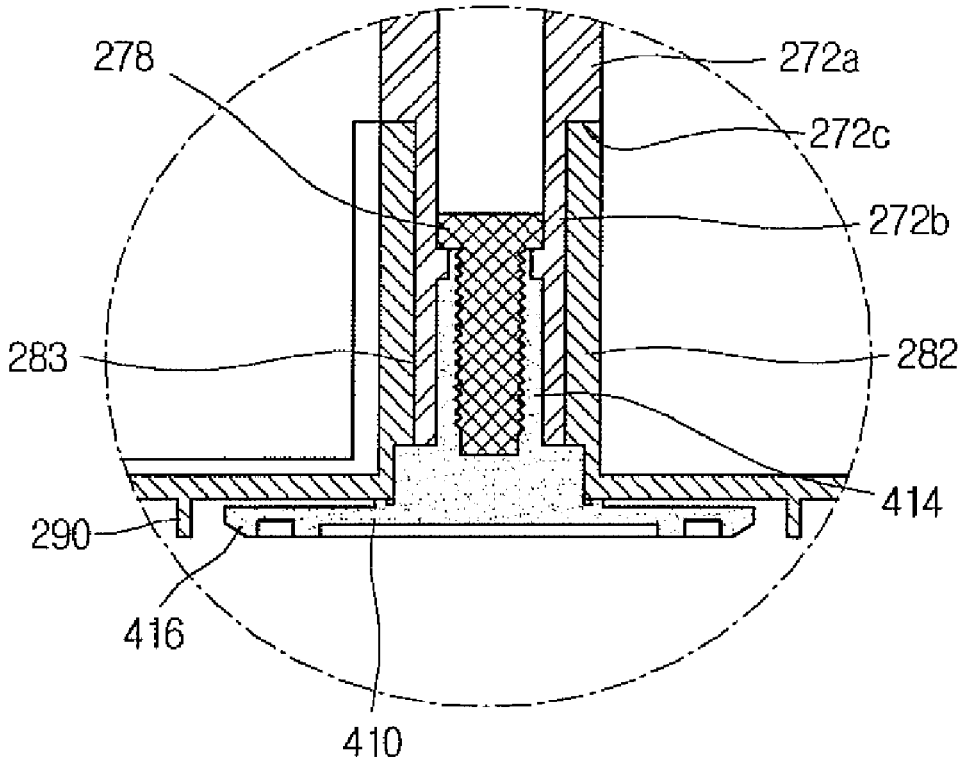
Figure 5:
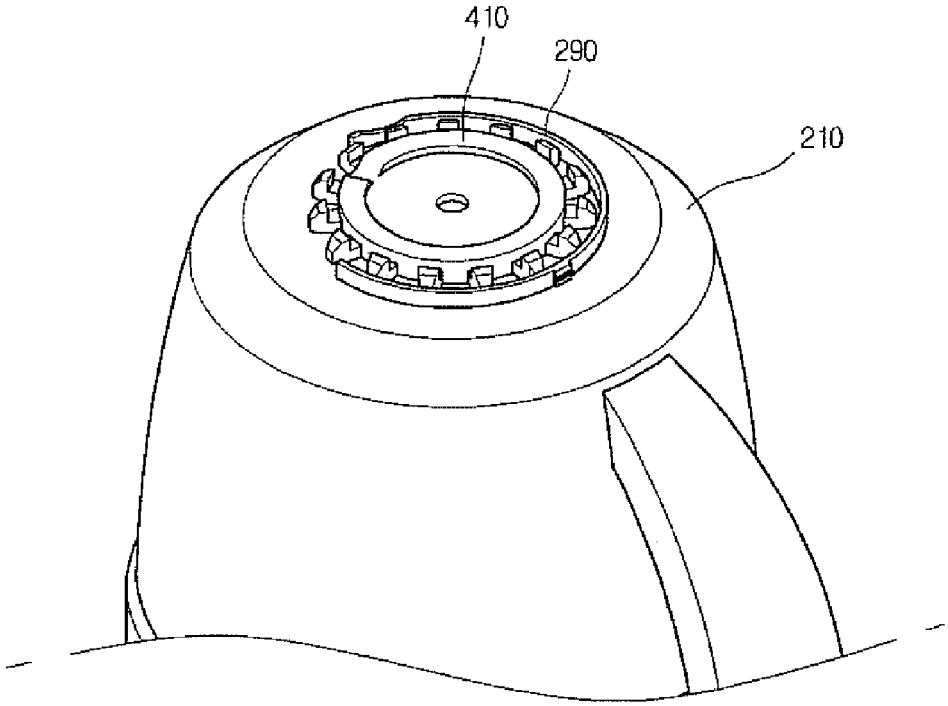
FIG. 5 is a bottom, perspective view of the dust collection device of FIG. 3.
Figure 6:
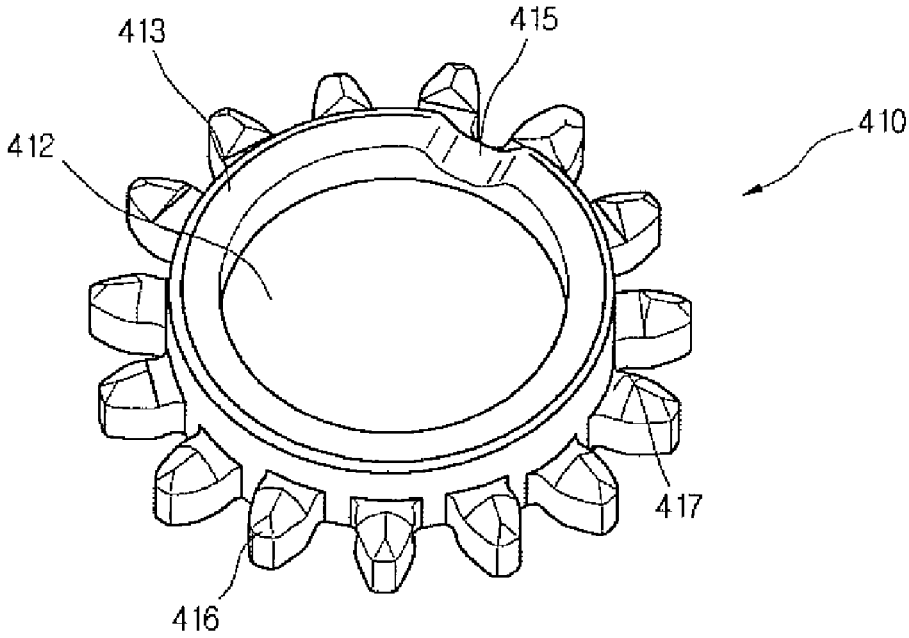
FIG. 6 is a bottom, perspective view of a driven gear of the vacuum cleaner of FIG. 1.
Figure 7:
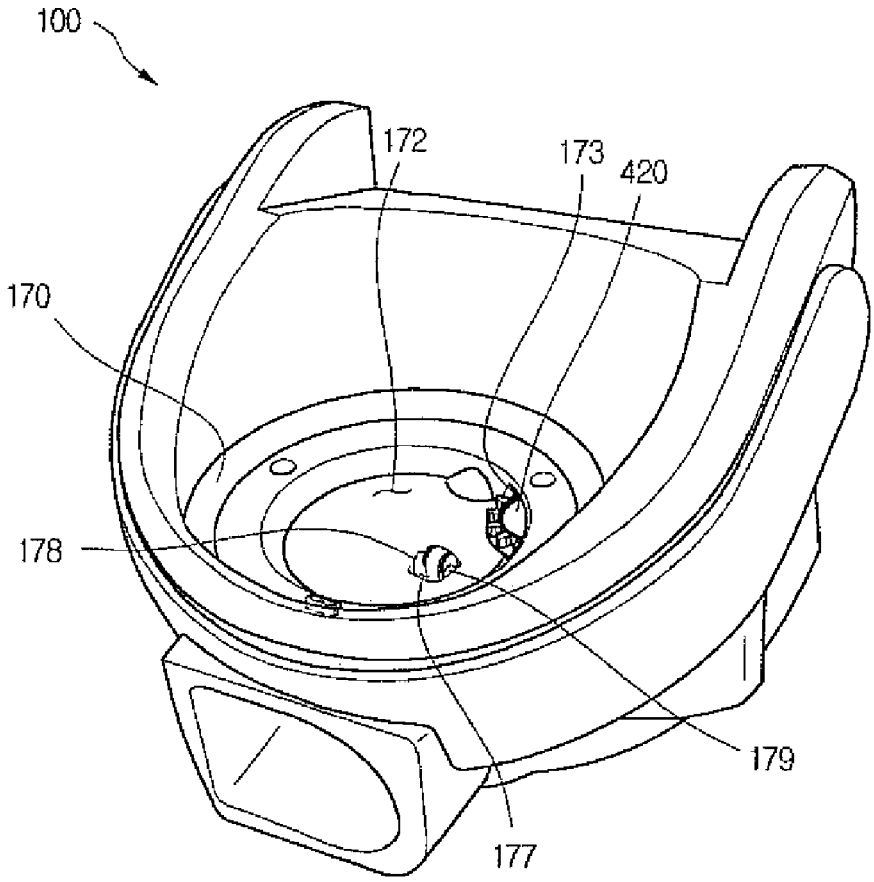
FIG. 7 is a perspective view of a dust collection device mounting portion of the vacuum cleaner of FIG. 1.
Figure 8:
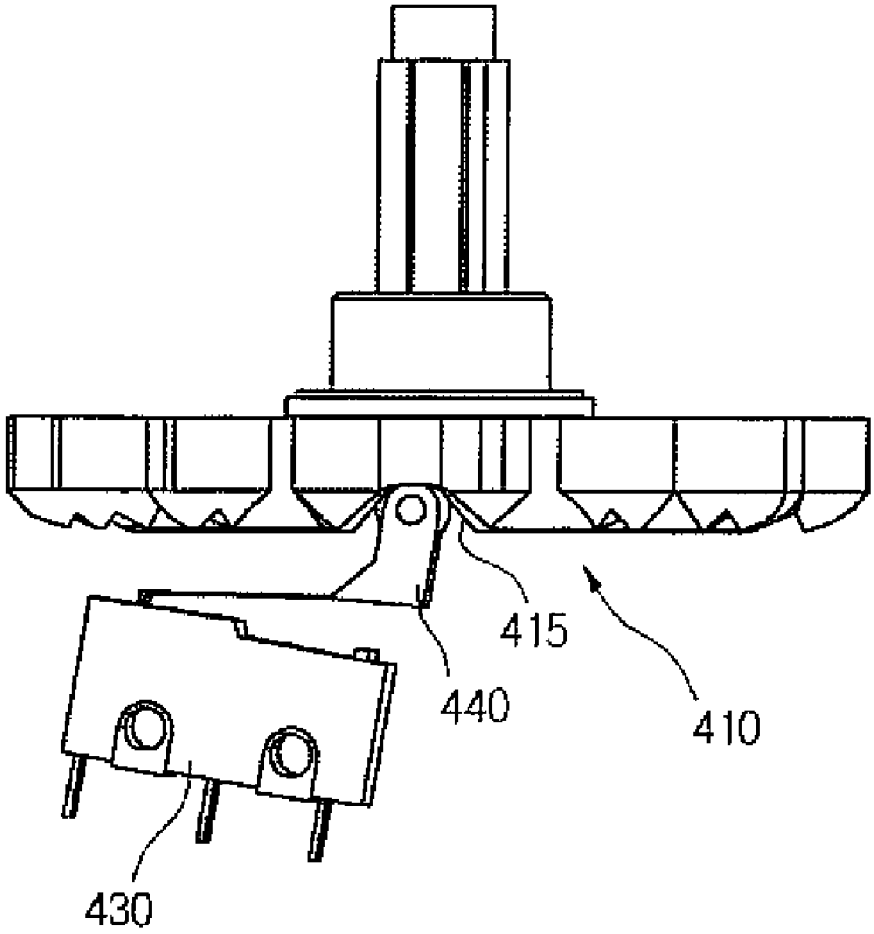
FIG. 8 is a view of a coupling relationship between a driven gear and a micro switch.

FIGS. 4A-4B are sectional views taken along line I-I of FIG. 3. FIG. 5 is a bottom, perspective view of the dust collection device of FIG. 3. FIG. 6 is a bottom, perspective view of a driven gear of the vacuum cleaner of FIG. 1. FIG. 7 is a perspective view of a dust collection device mounting portion of the vacuum cleaner of FIG. 1 FIG. 8 is a view of a coupling relationship between a driven gear and a micro switch.

Referring to FIGS. 4A-4B, the dust collection device 200 of this embodiment may include a dust collection body 210 that defines an outer appearance, the first cyclone device 230, which is selectively received in the dust collection body 210 to separate the dust from the air, and a cover member 250 that selectively opens and closes a top of the dust collection body 210. In more detail, the dust collection body 210 may be formed in an approximately cylindrical shape and may define a dust storing portion therein. The dust storing portion may include a first dust storing section 214, in which the dust separated in the first cyclone device 230 may be stored, and a second dust storing section 216, in which the dust separated in the second cyclone device 300 may be stored.

The dust collection body 210 may include a first wall 211 that defines the first dust storing section 214 and a second wall 212 that defines the second dust storing section 216 by association with the first wall 211. That is, the second wall 212 may be designed to enclose a portion of an outer side of the first wall 211.

The dust collection body 210 may have an open top and the cover member 25 may be detachably coupled to the top of the dust collection body 210. The first cyclone device 230 may be coupled to a lower portion of the cover member 250.

The first cyclone device 230 may be provided with a dust guide passage 232, along which the dust separated from the air may be effectively discharged to the first dust storing device 214. The dust guide passage 232 may guide the dust in a tangential direction and direct the dust downward.

An inlet 233 of the dust guide passage 232 may be formed on a side surface of the cyclone device 230. An outlet 234 may be formed on a bottom of the first cyclone device 230.

The cover member 250 may simultaneously open and close the first and second dust storing sections 214 and 216. An air outlet 251, through which the air from which the dust may be separated in the first cyclone device 230 may be discharged, may be formed on a bottom of the cover member 250. A filter member 260 provided at an outer circumference with a plurality of through holes 262, each having a predetermined size, may be coupled to an under surface of the cover member 250. Therefore, the air in the first cyclone device 230 may be discharged through the air outlet 251 via the filter member 260.

A passage 253 that directs the air of the first cyclone device 230 toward the first air outlet 252 may be formed in the cover member 250. That is, the passage 253 may function to connect the air outlet 251 to the first air outlet 252.

A pair of compression members 270 and 280 that may increase a dust collection amount by reducing a volume of the dust stored in the first dust storing device 214 may be provided in the dust collection body 210. The compression members 270 and 280 may compress the dust stored in the first dust storing section by cooperating with each other, thereby maximizing the dust collection amount of the dust collection device 200. For convenience, the compression members 270 and 280 will be, respectively, referred to as first and second compression members.

In this embodiment, at least one of the compression members 270 and 280 may be movably disposed in the dust collection body 210, so that the dust may be compressed between the first and second compression members 270 and 280. When the first and second compression members 270 and 280 are rotatably provided in the dust collection body 210, the first and second compression members 270 and 280 may rotate to move toward each other to compress the dust therebetween.

However, in this embodiment, the first compression member 270 may be rotatably provided in the dust collection body 210, while the second compression member 280 may be fixed in the dust collection body 210. Therefore, the first compression member 270 may be a rotational member, while the second compression member 280 may be a stationary member.

In more detail, the second compression member 280 may be provided between an inner circumference of the dust collection body 210 and a rotational shaft 272 that defines a rotational center of the first compression member 270. That is, the second compression member 280 may be provided on a plane that connects an axis of the rotational shaft 272 to the inner circumference of the first dust storing section 214. The second compression member 280 may completely or partly block a space defined between the inner circumference of the first dust collection section 214 and an axis of the rotational shaft 272, so that dust may be compressed by the first compression member 270 when it rotates. A first end of the second compression member 280 may be integrally formed with the inner circumference of the dust collection body 210 and a second end of the second compression member 280 may be integrally formed with a fixed shaft 282 that is provided on a common axis with the rotational shaft 272 of the first compression member 270.

Only one of the first and second ends of the second compression member 280 may be integrally formed with the inner circumference of the dust collection body 210 or the fixed shaft 282. When the first end of the second compression member 280 is not integrally formed with the inner circumference of the dust collection body 210, the first end of the second compression member 270 may be disposed adjacent to the inner circumference of the dust collection body 210. When the second end of the second compression member 280 is not integrally formed with the fixed shaft 282, the second end of the second compression member 270 may be disposed adjacent to the fixed shaft 282. Therefore, leakage of dust through a clearance formed on a side of the second compression member 280 may be minimized when the dust is pushed by the first compression member 270.

The first and second compression members 270 and 280 may comprise respective rectangular plates. The rotational shaft 272 of the first compression member 270 may be provided on a common axis with a vertical axis that defines a center of the dust collection body 210.

The fixed shaft 282 may protrude from a first end of the dust collection body 210 toward an inside. A hollow portion 283 may be formed in an axial direction inside the fixed shaft 282 to fix the rotational shaft 272. That is, the rotational shaft 272 may be partly inserted from a top of the fixed shaft 282 into the hollow portion 283.

The rotational shaft 272 may be provided with a stepped portion 272*c* supported by a top of the fixed shaft 282. The rotational shaft 272 may be divided into upper and lower shafts 272*a* and 272*b* with reference to the stepped portion 272*c*. The compression member 270 may be coupled to the upper shaft 272*a*. A driven gear that rotates the first compression member 270 may be coupled to the lower shaft 272*b*.

The vacuum cleaner of this embodiment may further include a driving apparatus that drives the first compression member 270. The following will describe a relationship between the dust collection device 200 and the driving apparatus with reference to FIGS. 5 through 8.

Referring to FIGS. 5 through 8, the driving apparatus that rotates the first compression member 270 may include a driver or driving device (not shown) that generates a driving force and a power transmission device that transmits the driving force of the driving device to the first compression member 270. In more detail, the power transmission device may include a driven gear 410 coupled to the rotational shaft 272 of the first compression member 270 and a driving gear 420 that transmits the power to the driven gear 410. The driving device may be a compression motor coupled to the driving gear 420.

A gear shaft 414 of the driven gear 41 may be coupled to the rotational shaft 272 of the first compression member 270 at a lower side of the dust collection body 210. As the driven gear 41 is coupled to the lower side of the dust collection body 210, the driven gear 410 may be exposed out of the dust collection body 210.

The compression motor may be provided under the dust collection device mounting portion 170, and the driving gear 420 may be provided on a bottom surface of the dust collection device mounting portion 170 and coupled to the rotational shaft of the compression motor. A portion of the outer circumference of the driving gear 420 may be exposed to an external side at a bottom of the dust collection device mounting portion 170. The dust collection device mounting portion 170 may be provided at the bottom with an opening 173 that exposes a portion of the outer circumference of the driving gear 420 from the dust collection device mounting portion 170.

As the driven gear 410 is exposed from the dust collection mounting portion 170, the driven gear 410 may be engaged with the driving gear 420 when the dust collection device 200 is mounted on the dust collection device mounting portion 170. Therefore, when the compression motor is driven, the driving gear 420 coupled to the compression motor may rotate to transmit torque of the compression motor to the driven gear 410. The torque transmitted to the driven gear 410 may rotate the first compression member 270.

A guide rib 290 that guides mounting of the dust collection device 200 may be formed on a lower side of the dust collection body 210. The dust collection device mounting portion 170 may be provided with an insertion groove 172, in which the guide rib 290 may be inserted.

The guide rib 290 may be provided in a C-shape at an outer side of the driven gear 410 to enclose a portion of the driven gear 410. Therefore, the guide rib 290 may function to protect the driven gear 4100 and prevent dust from moving toward the driven gear 410.

A micro switch 430 that detects a rotational position of the driven gear 410 may be provided under the dust collection device mounting portion 170. A terminal 440 that turns on/off the micro switch 430 by contacting the driven gear 410 may be exposed to the dust collection device mounting portion 170.

A through hole 177 that exposes a part of the terminal 440 may be formed in the dust collection device mounting portion 170. Inner and outer ribs 178 and 179 that protects the exposed terminal 440 may be formed on an edge of the through hole 177.

The following will describe a relationship between the driven gear 410 and the micro switch 430.

Referring to FIGS. 6 through 8, the micro switch 430 may be disposed under the driven gear 410, such that the terminal 440, which turns on/off the micro switch, may contact a lower portion of the driven gear 410. The driven gear 410 may include a body 412, a contact rib 413 that extends downward from a lower edge of the body 412 and contacts the terminal 440, and a plurality of gear teeth formed along a side surface of the body device 412.

The contact rib 413 may be provided with an identification groove 415 that identifies a position of the driven gear 410 by preventing the driven gear 410 in a predetermined position from contacting the terminal 440. The non-contacting of the terminal 440 with the contact rib 413 means that a portion of the terminal 440 may be inserted, and thus, may not contact the under surface of the contact rib 413.

When the dust collection device 200 is mounted on the dust collection device mounting portion 170, the terminal 440 exposed through the through hole 177 may contact the under surface of the contact rib 413 to press a contact point 432 of the micro switch 430. In addition, when the driven gear 410 rotates to a predetermined position, the terminal 440 may be partly inserted in the identification groove 415, and thus, the terminal 440 may be detached from the contact point 432.

The micro switch 430 may be turned off only when the terminal 440 is located in the identification groove 415. The micro switch 430 may maintain the on-state when the terminal 440 contacts the contact rib 413.

Therefore, when the driven gear 410 rotates, the micro switch 430 may maintain the on-state, except when the terminal 440 is located in the position identification groove 415. The micro switch 430 may be turned on only when the terminal 440 is located in the location identification groove 415. In other cases, the micro switch 430 may be turned off when the terminal 440 contacts the contact rib 413.

The gear tooth 416 may be provided at a lower portion with an interference preventing groove 417 that prevents the dust collection device 200 from interfering with the outer rib 179 when the dust collection device 200 is mounted. Therefore, when the dust collection device 200 is mounted on the dust collection mounting portion 170, the outer rib 179 may be located in the interference preventing groove 417 and the inner rib 178 may be located in a space defined by the contact rib 413.

The micro switch 430 may detect mounting of the dust collection device 200. That is, when the dust collection device 200 is mounted on the dust collection device mounting portion 170, the contact rib 413 may press the terminal 440. Then, the terminal 440 may press the contact point 432 formed on the micro switch 430 to turn on the micro switch. Since the micro switch 430 is turned on when the dust collection device is mounted, the mounting of the dust collection device 200 may be detected by the micro switch 430. The reason that mounting of the dust collection device 200 is detected is to prevent the suction motor and the compression motor from operating in a state in which the dust collection device 200 is not mounted.

The mounting of the dust collection device 200 may be detected by the micro switch 430 in this embodiment. However, the present disclosure is not limited to this embodiment. For example, a pressure sensor may be mounted on the dust collection device mounting portion 170.

Figure 9:
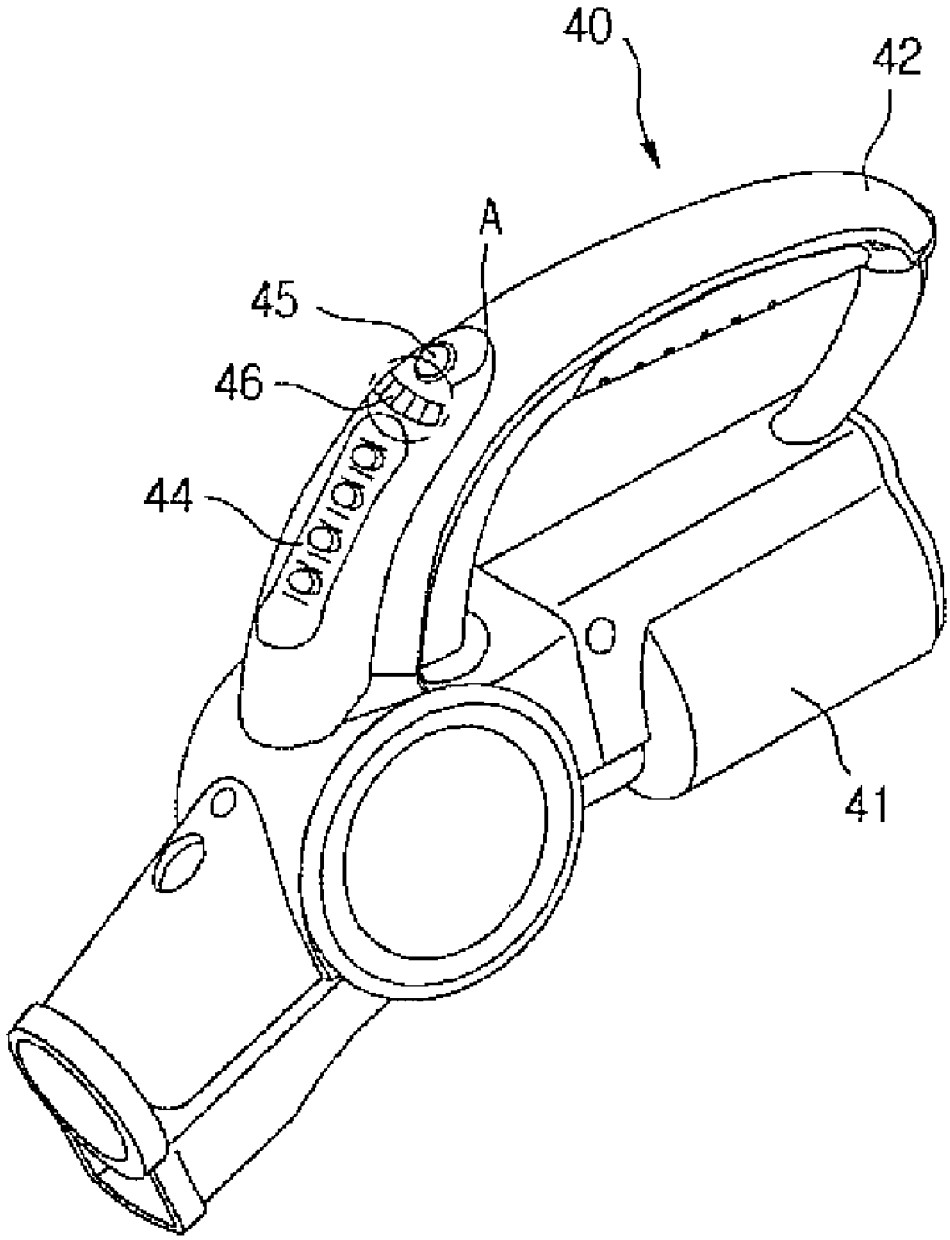
FIG. 9 is a perspective view of a handle of the vacuum cleaner of FIG. 1.
Figure 10:
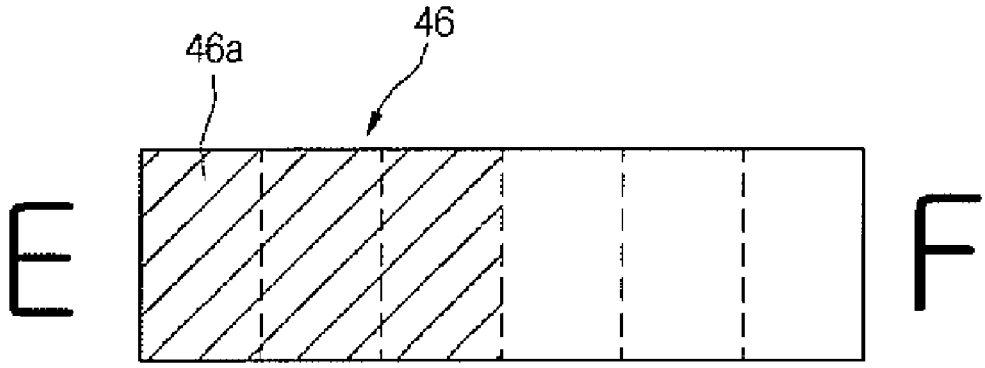
FIG. 10 is an enlarged view of a portion A of FIG. 9.

A more detailed explanation of the microswitch is provided in U.S. patent application Ser. No. 11/956,133, which is hereby incorporated by reference FIG. 9 is a perspective view of a handle of the vacuum cleaner of FIG. 1. FIG. 10 is an enlarged view of a portion A of FIG. 9.

Referring to FIGS. 9 and 10, the handle 400 of this embodiment may include a handle body 41 and a grasping portion 42 configured to be grasped by a user and provided above the handle body 41. A manipulation device 44 may be provided on the grasping portion 42 to manipulate operation of the vacuum cleaner 10. For example) the operation of the suction motor and the on/off of the compression motor may be controlled by the manipulation device 44. In addition, a mode selection device 45 that selects an operational mode of the compression motor may be provided at a side of the manipulation device 44. The operational mode will be described in more detail later.

A dust amount display 46 may be formed at a side of the manipulation device 44 to display an amount of dust stored in the dust collection device 200. The dust amount display 45 may have a plurality of dust amount display sections 45*a* that are sequentially arranged. LEDs (not shown) may be provided in the respective dust amount display sections 45*a*. As the amount of the dust increases, a number of LEDs that are turned on may be increased, and thus, a number of the dust amount display sections 45*a* that are turned on may be increased. In FIG. 10, the reference characters E and F indicate "empty" and "full", respectively. Therefore, the dust amount display sections may be sequentially increased from E to F and the user may identify an amount of the dust stored in the dust collection device 200 by identifying the number of the dust amount display sections 45*a* that are turned on.

Figure 11:
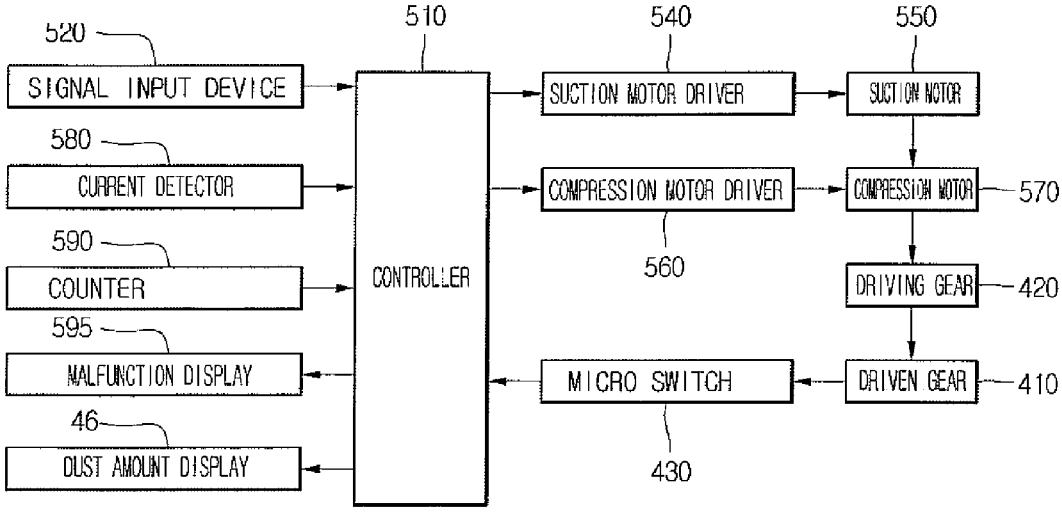
FIG. 11 is a block diagram illustrating a control structure of the vacuum cleaner of FIG. 1.
Figure 12A:
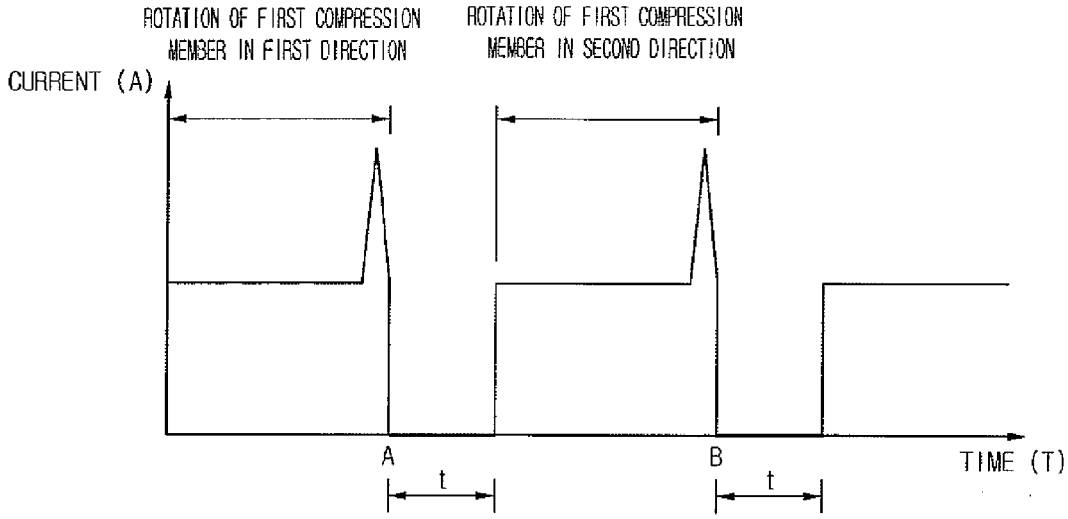
FIGS. 12A-12B are phase wave forms of current and power of a compression motor in accordance with dust compression time.
Figure 12B:
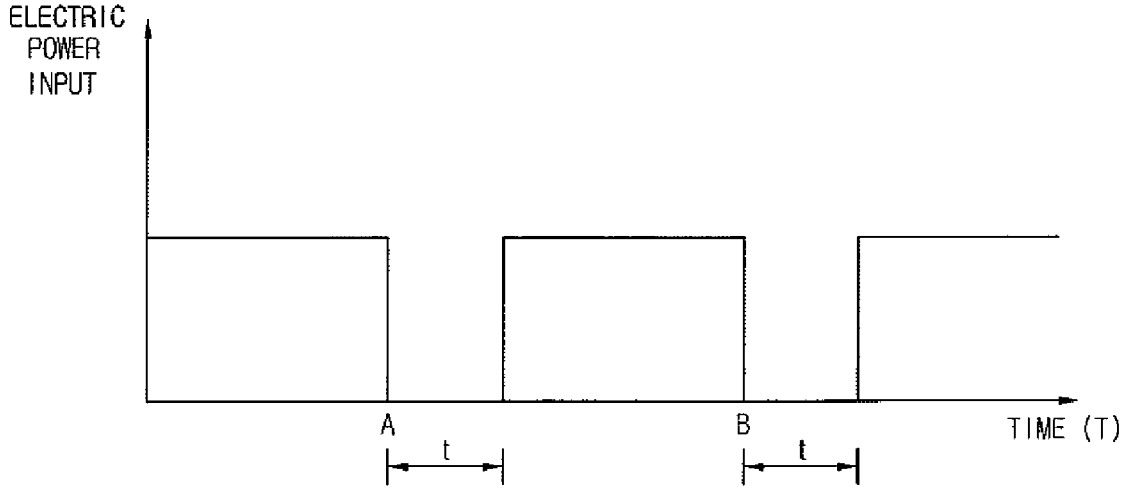

FIG. 11 is a block diagram illustrating a control structure of the vacuum cleaner of FIG. 1. FIGS. 12A and 12B are phase wave forms of current and power of a compression motor in accordance with dust compression time. That is, FIG. 12A is a current phase waveform of the compression motor, and FIG. 12B is a power phase waveform.

Referring to FIGS. 11 and 12A-12B, the vacuum cleaner of this embodiment may include a controller 520, a signal input device 520 that inputs an operational condition of the vacuum cleaner, a suction motor driver 540 that operates a suction motor 550 in accordance with an operational mode input from the signal input device 520, a compression motor driver 560 that operates the compression motor 570 to compress the dust, a driving gear 420 driven by the compression motor 570, a driven gear 410 engaged with the driving gear 420, a micro switch 430 that is turned on and off in accordance with the rotation of the driven gear 410, and a counter 580 that measures an on/off time of the micro switch 430.

The vacuum cleaner of this embodiment may further include a current detector 580 that detects a current value of the compression motor 570, a display 595 that displays malfunction of the compression member 270, and a dust amount display 46 that displays a dust amount of the dust collection device.

As described above, the compression motor 570 may be provided under the dust collection device mounting portion 170 to rotate the driving gear 420. The compression motor may be a reversible motor. That is, the compression motor may be a motor that may rotate in opposite directions. Therefore, the first compression member 270 may rotate in forward and rearward directions, and thus, the dust may be accumulated at both sides of the second compression member 280.

Further, the compression motor may be a synchronous motor that may rotate in opposite directions. Synchronous motors are designed to rotate in the opposite directions. When a load applied to the motor is greater than a predetermined value as the motor rotates in a first direction, the motor is designed to rotate in a second direction. The load applied to the motor may be a torque. Since synchronous motors are well known in the art, a detailed description thereof has been omitted herein.

When the load applied to the first compression member 270 is greater than a predetermined value, a current value of the compression motor 570 may be steeply increased, as shown in FIG. 12A. In more detail, when the first compression member 270 rotates in the first direction, the dust between the first and second compression members 270 and 280 may be compressed as the first compression member 310 rotates to a first side of the second compression member 280. The rotation of the first compression member 270 may continue until the load applied to the motor reaches the predetermined value. When the load reaches the predetermined value, the current value of the compression motor 570 may steeply increase and this current variation may be detected by the current detector 580.

The current value detected by the current detector 580 may be transmitted to the controller 510, and the controller 510 may transmit a signal that interrupts the electric power to the compression motor driver 560. Then, the compression motor 570 may stop operating, and thus, the first compression member 270 may stop in a dust compression state. The first compression member 270 may continue compressing the dust for a reference cut-off time t at the stopped position.

When the reference cut-off time t has elapsed, the controller 510 may transmit a power applying signal of the compression motor 570 to the compression motor driver 560, and thus, the compression motor 570 and the first compression member 270 may rotate. Since the first compression member 270 may stop rotating in a state in which the load reaches the predetermined value, the first compression member 270 may rotate in the second direction. When the second compression member 270 rotates in the second direction, the dust between the first compression member 270 and the second compression member 280 may be compressed as the first compression member 270 rotates toward a second side of the second compression member 280.

As described above, when the load applied to the compression member 270 reaches the predetermined value during the rotation of the first compression member 270, the electric power applied to the compression motor 570 may be cut off, and thus, the first compression member 270 may stop rotating in a state in which it compresses the dust. In addition, the first compression member 270 may keep compressing the dust for the reference cut-off time at a position at which the first compression member 270 stops. When the predetermined time has elapsed, the compression motor 570 may be driven again, and thus, the first compression member 270 may rotate in an opposite direction.

When the reference cut-off time is relatively short (for example, substantially close to 0), the dust may be continuously compressed at both sides of the second compression member 270. When the reference cut-off time is relatively long, the dust may be continuously compressed at one side of the second compression member and power consumption of the compression motor may be reduced by the intermittent operation of the compression motor.

That is, when an amount of the dust stored in the dust collection unit 200 per device time is low, there is no need to unnecessarily rotate the compression motor 570. In this case, the reference cut-off time may be increased.

Therefore, in this embodiment, the operational mode of the compression motor 570 may include a first mode having a short reference cut-off time and a second mode having a long reference cut-off time. The operation mode of the compression motor may be selected by the mode selection device 45 (see FIG. 9). Since the compression motor 570 may continuously operate in the first mode, the first mode may be referred to as a "Continuous Mode."

Figure 13:
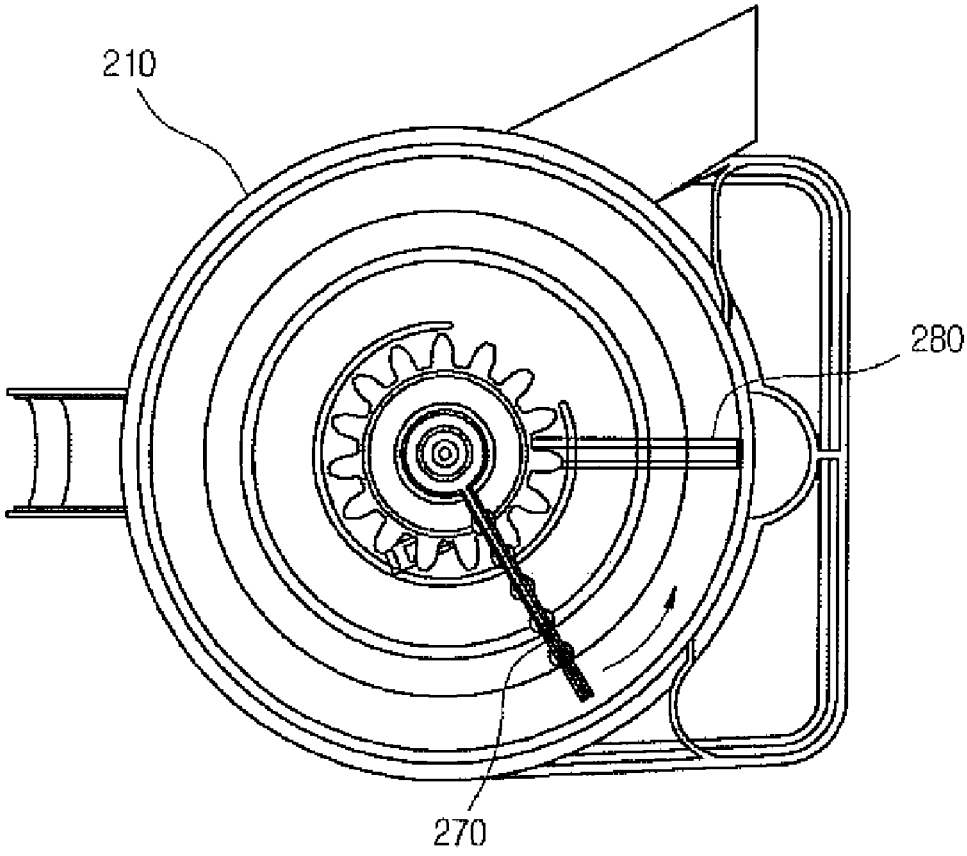
FIGS. 13 and 14 are views illustrating an on-state of a micro switch when a first compression member that compresses dust approaches a first side of a second compression member.
Figure 14:
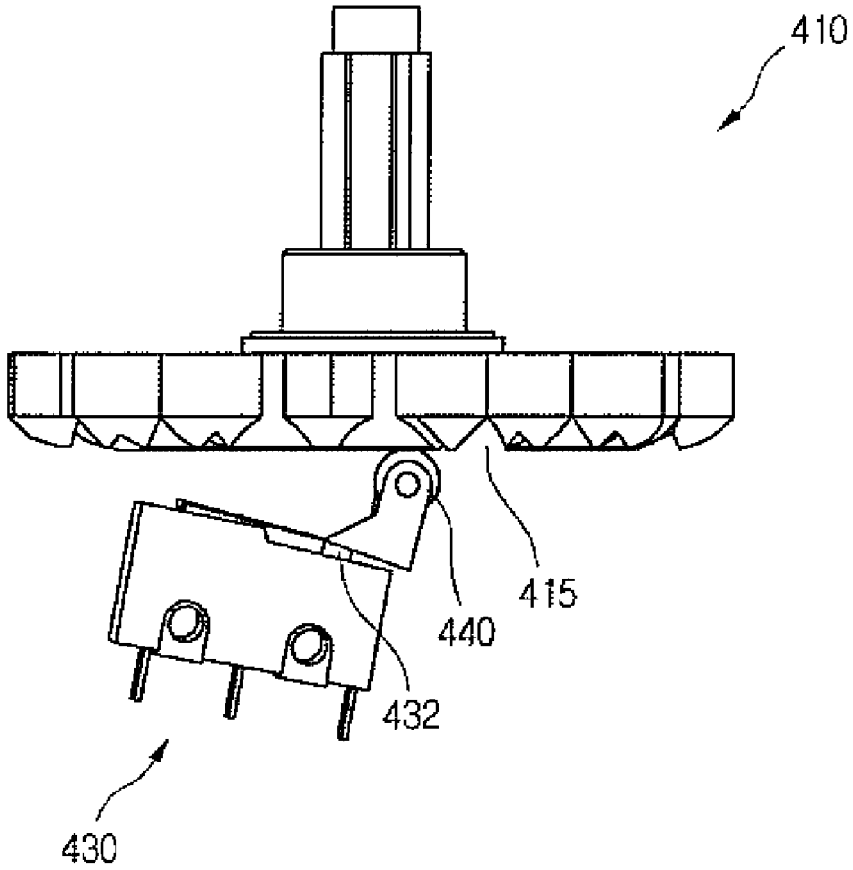
Figure 15:
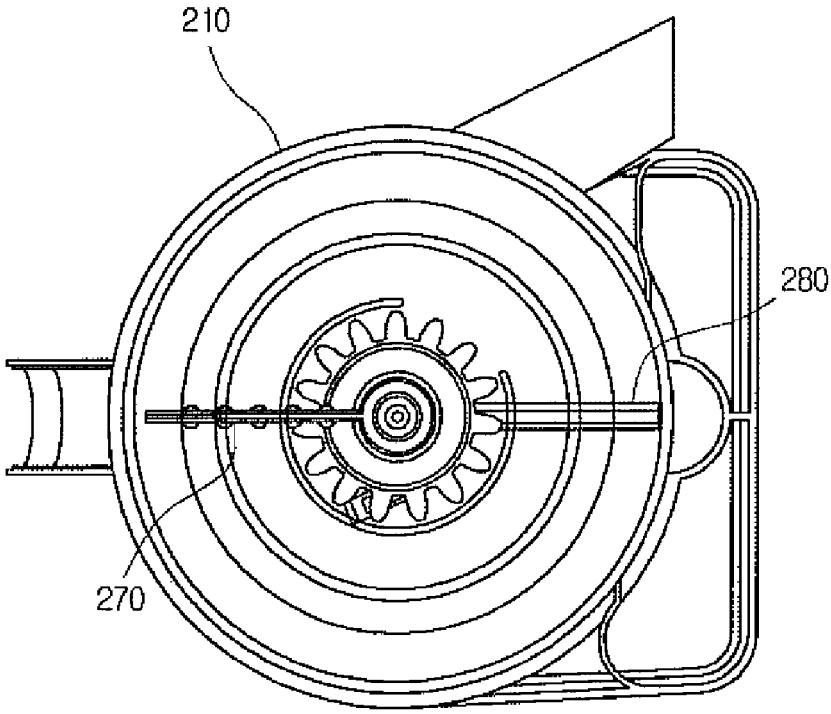
FIGS. 15 and 16 are views illustrating an off-state of a micro switch when first and second compression members are inline.
Figure 16:
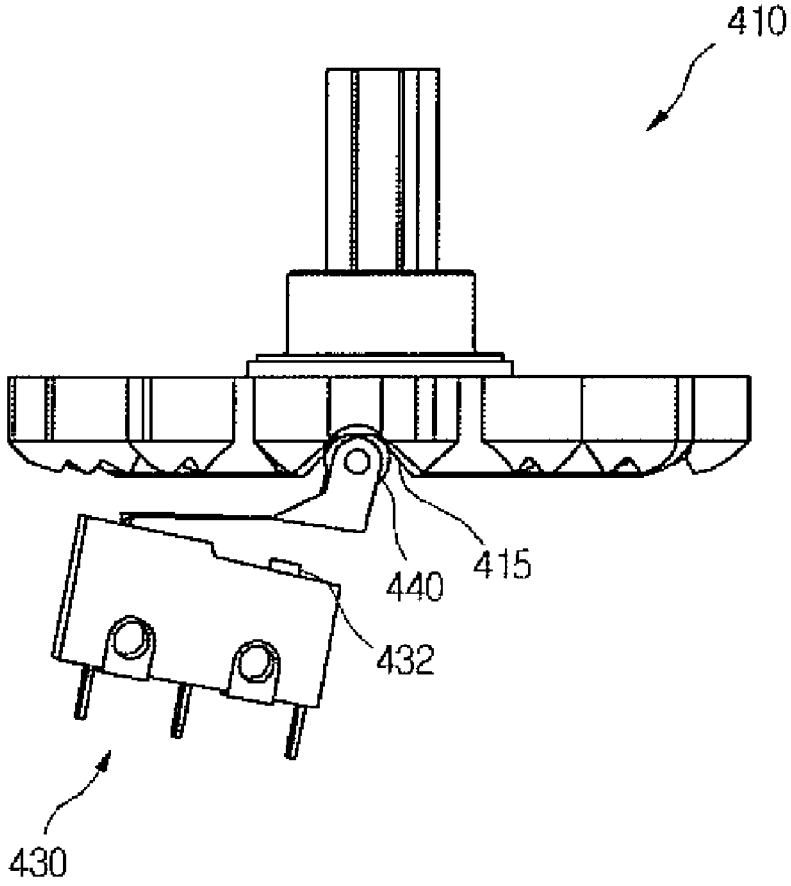
Figure 17:
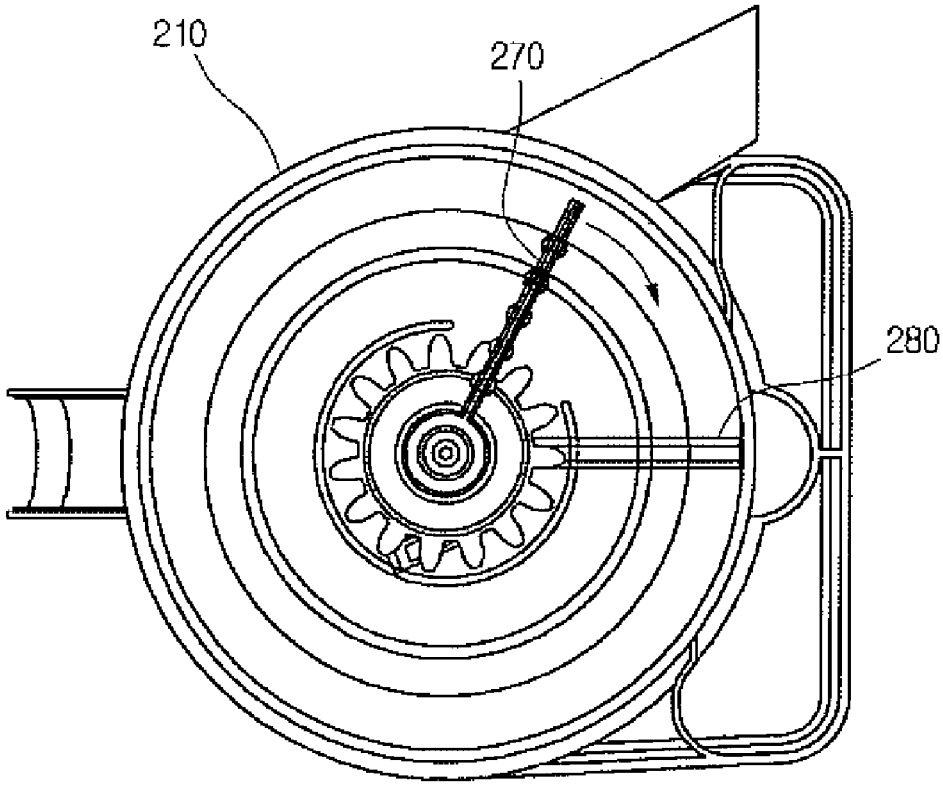
FIGS. 17 and 18 are views illustrating an on-state of a micro switch when a first compressing member that compresses dust approaches a second side of a second compression member.
Figure 18:
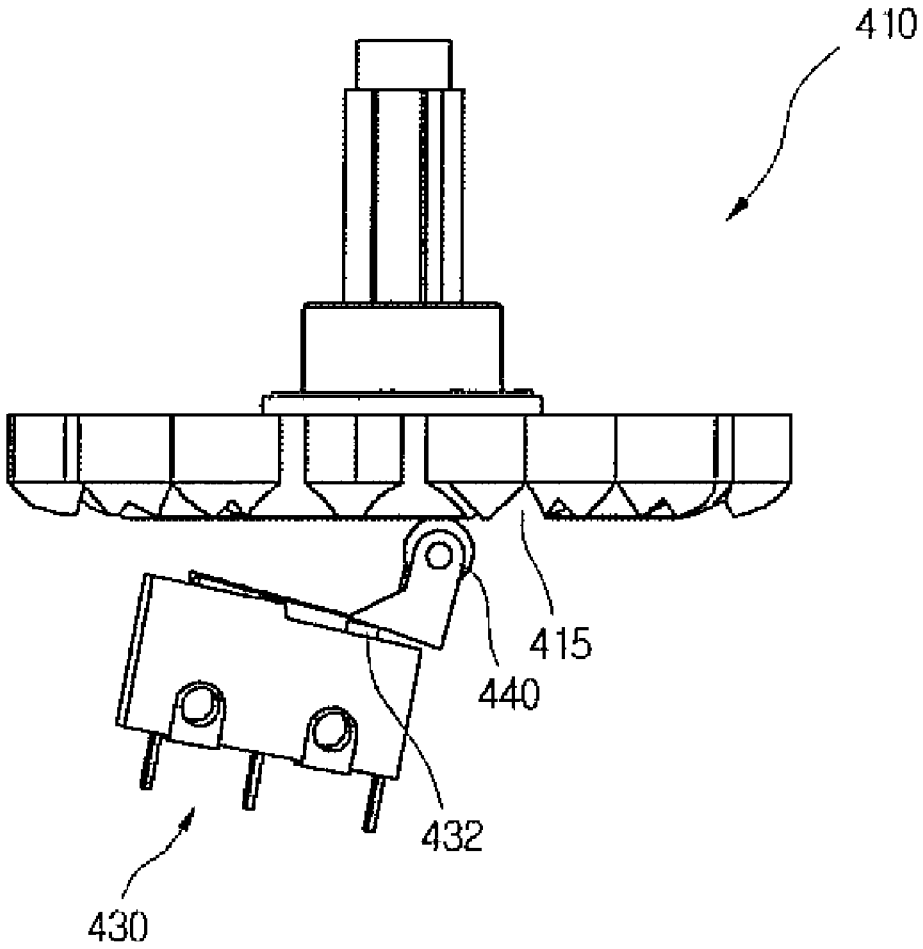

FIGS. 13 and 14 are views illustrating an on-state of a micro switch when a first compression member that compresses dust approaches a first side of a second compression member. FIGS. 15 and 16 are views illustrating an off-state of a micro switch when first and second compression members are inline. FIGS. 17 and 18 are views illustrating an on-state of a micro switch when the first compressing member that compresses dust approaches a second side of the second compression member.

Referring to FIGS. 13 through 18, when the first compression member 270 rotates approximately 180-degree with reference to the second compression member 280, and thus, is disposed inline therewith, the terminal 440 may be located in a position identification groove 415 of the driven gear 410. In this case, the terminal 440 may be spaced apart from a contact point 432, and thus, the micro switch 430 turned off. The position of the first compression member 270 depicted in FIG. 15, where the micro switch 430 is turned off will be referred to as a "reference position" for descriptive convenience.

While the first compression member 270 compresses the dust stored in the dust collection body 210 as it rotates counterclockwise from the reference position, the terminal 440 may contact the contact rib 413 of the driven gear 410. Therefore, as shown in FIG. 14, the terminal 440 may press the contact portion 432 of the micro switch 430, and thus, the micro switch 430 may be turned on.

When the first compression member 270 cannot rotate counterclockwise due to the dust, the first compression member 270 may rotate clockwise. Therefore, the first compression member 270 may rotate toward the right side of the second compression member 280, as shown in FIG. 17, over the reference position shown in FIG. 15, thereby compressing the dust stored in the dust collection body 210. When the first compression member 270 cannot rotate clockwise due to the compressed dust, the compression motor 570 may rotate counterclockwise and the above-described process may be repeated, thereby compressing the dust stored in the dust collection body 210.

Figure 19:
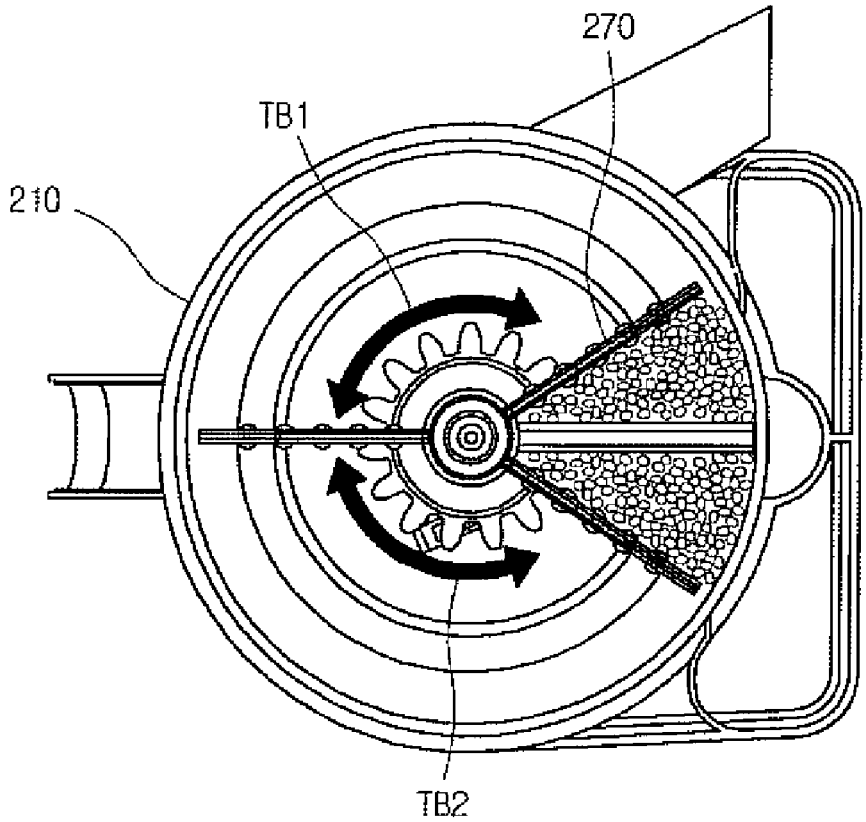
FIG. 19 is a view illustrating rotational operation of the first compression member of FIGS. 13 through 18.

FIG. 19 is a view illustrating rotational operation of the first compression member of FIGS. 13 through 18. FIG. 19 shows a first reciprocation time TB1 taken when the first compression member 270 rotates clockwise from the reference position and is returned to the reference position, and a second reciprocation time TB2 taken when the first compression member 270 rotates counterclockwise from the reference position and is returned to the reference position. Since the dust is uniformly dispersed in the dust collection body 210, the first reciprocation time TB1 is almost the same as the second reciprocation time TB2.

As an amount of the dust compressed by the first compression member 270 increases, the first and second reciprocation times TB1 and TB2 may be shortened. In this embodiment, the amount of the dust stored in the dust collection body may be determined by detecting the first and second reciprocation times TB1 and TB2.

Figure 20:
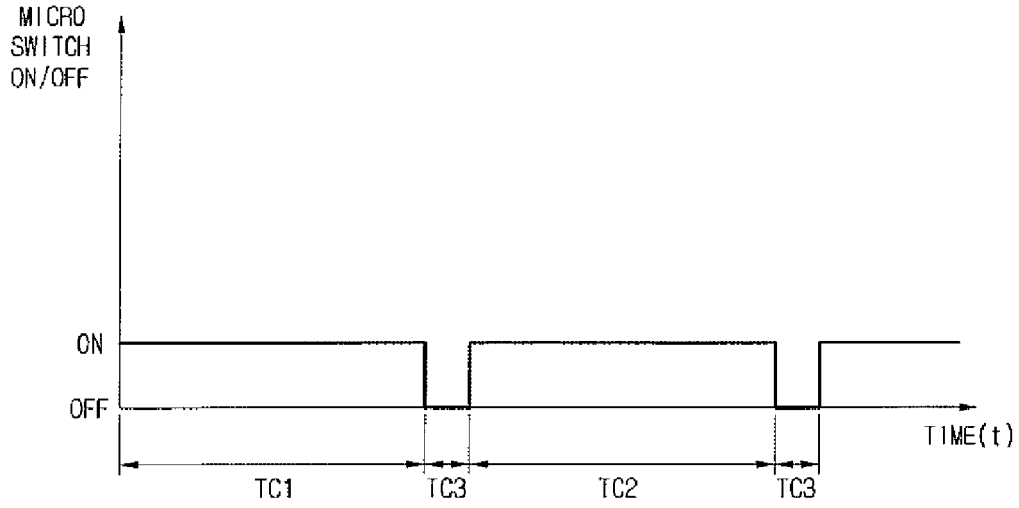
FIG. 20 is a graph illustrating an on/off state of a micro switch in accordance with rotational motion of the first compression member.

FIG. 20 is a graph illustrating an on/off state of the micro switch in accordance with the reciprocation motion of the first compression member. FIG. 20 shows a first reference time TC1 when the first compression member 270 rotates clockwise from the reference position and is returned to the reference position in a state in which no dust is stored in the dust collection device 200, and a second reference time TC2 when the first compression member 270 rotates counterclockwise from the reference position and is returned to the reference position in a state in which no dust is stored in the dust collection device 200. The reference times TC1 and TC2 may correspond to an on-time of the micro switch.

When the dust is continuously stored in the dust collection device 200, the actual reciprocation times TB1 and TB2 of the first compression member 270 may become less than the reference times TC1 and TC2. However, when the first compression member 270 malfunctions, the actual reciprocation times TB1 and TB2 of the first compression member 270 may be greater than the reference times TC1 and TC2.

For example, when foreign objects clog a space between the first compression member 270 and the dust collection body 210, a rotational speed of the first compression member 270 may be significantly reduced as compared with its original speed or the first compression member 270 may stop rotating. In this case, the on-time of the micro switch 430 may become greater than the reference times TC1 and TC2.

Therefore, in this embodiment, to determine if the first compression member 170 malfunctions, it is determined if the actual reciprocation times TB1 and TB2 of the first compression member 270 are greater than limit times TD1 and TD2, which are greater than the reference times TC1 and TC2.

The reason for comparing the actual reciprocation times of the first compression member 270 with the limit times is to accurately determine the malfunction of the compression motor 570 considering rotational error. In this embodiment, the malfunction of the first compression member may be determined by comparing the actual reciprocation times of the first compression member 270 with the limit times. However, the malfunction may be further determined by comparing a time for which the first compression member 270 is in the reference position with a limit time TB3.

As described above, the micro switch 430 may function as a position detector that detects the reference position of the first compression member 270 by cooperating with the driven gear 410. The micro switch 430 may function as a malfunction detector that detects the malfunction of the first compression member 270 during the on/off process of the micro switch.

The following will describe a dust compression process.

Figure 21:
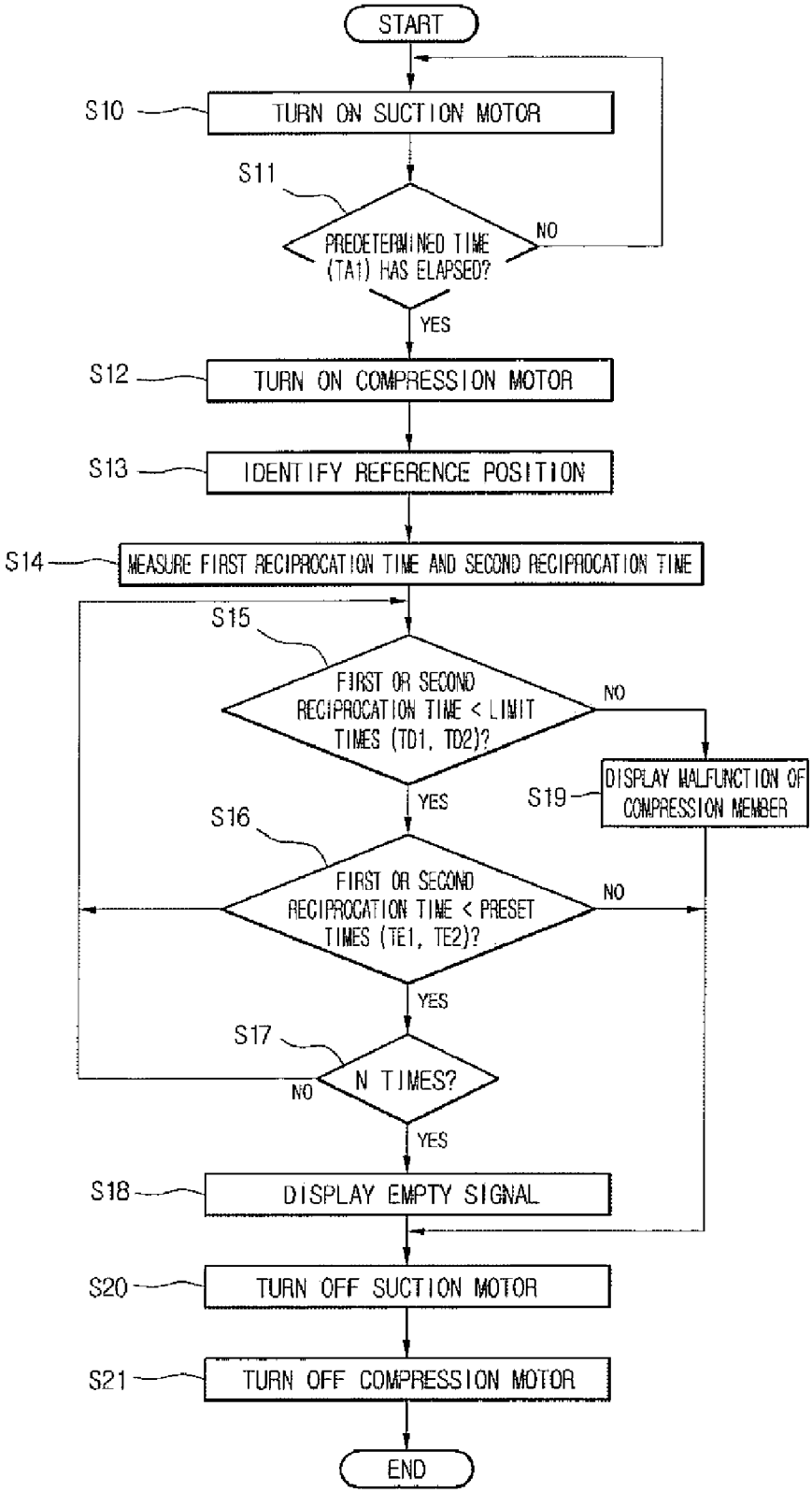
FIG. 21 is a flowchart of a control method of a vacuum cleaner according to an embodiment.

FIG. 21 is a flowchart of a control method of the vacuum cleaner according to an embodiment. Referring to FIG. 21, a user operates the vacuum cleaner by selecting one of high, medium, and low modes representing suction power using the signal input device 520. Then, the controller 510 operates the suction motor driver 540 to operate the suction motor 550 in accordance with the selected suction mode, in step S10.

When the suction motor 550 operates, dust may be sucked in through the suction nozzle by the suction of the suction motor 550. The air sucked in through the suction nozzle may be directed into the main body 100 through the main body suction device 110. The introduced air may be directed into the dust collection device 200 along a predetermined passage.

The air introduced into the dust collection device 200 may go through a dust separation process, after which the air may be discharged to the main body 100. The separated dust may be stored in the first dust storing section 214.

During the dust separation process by the operation of the suction motor 550, the controller 510 may determine if the on-time of the suction motor reaches an operation reference time TA1, in step S11. The operation reference time TA1 may be measured by the counter 580.

When the on-time of the suction motor 550 reaches the reference time TA1, the controller 510 may operate the compression motor 540 to compress the dust stored in the dust collection device 200, in step 200 S12. When the user does not select the operational mode of the compression motor 570 through the mode selection device 45, the compression motor 570 may operate in a former mode or a first mode (continuation mode).

The reason for operating the compression motor 570 after the predetermined period of time has elapsed after the suction motor 550 begins operating is to prevent the compression motor 570 from unnecessarily operating during an initial operation of the suction motor 550. That is, when the suction motor 550 operates in a state in which no dust is stored in the dust collection device 200, a predetermined period of time for accumulating a predetermined amount of the dust in the dust collection device 200 is necessary. That is, there is no need to operate the compression motor 570 until the predetermined amount of the dust is stored in the dust collection device 900. Therefore, the compression motor 570 may maintain a stopped state until the predetermined amount of the dust is stored in the dust collection device 200, to prevent the compression motor 570 from unnecessarily operating. Even when the suction motor 550 operates in a state in which dust is stored in the dust collection device 200, since the dust is compressed before the suction motor 570 operates, the stopped state of the compression motor 570 may be maintained until a predetermined amount of the dust is additionally accumulated in the dust collection device 200, thereby preventing the compression motor from unnecessarily operating.

When the compression motor 570 is driven, the driving gear 420 coupled to the rotational shaft of the compression motor 570 may rotate, and thus, the driven gear 410 engaged with the driving gear 420 may rotate. When the driven gear 410 rotates, the first compression member 270 coupled to the driven gear 410 may rotate toward the second compression member 280 to compress the dust.

The controller 510 may first determine if the first compression member 270 is in the reference position, in step S13. In this embodiment, since the first and second reciprocation times may be measured with reference to the reference position of the first compression member 270, if the first compression member 270 is in the reference position when the compression is initiated may be determined. The reference position of the first compression member 270 may be a time point at which the micro switch 430 is initially turned off. Therefore, the counter 580 may measure the first or second reciprocation time TB1 or TB2 with reference to the time point at which the micro switch is initially turned off, in step S14.

As an amount of dust compressed in the dust collection device 210 by the first and second compression members 270 and 280 increases, the reciprocation time of the driven gear 410 may be shortened. In addition, the controller may determine a current dust amount using the reciprocation time detected. The determined dust amount may be displayed on the dust amount display 46.

After the above, the controller 510 may determine if the first or second reciprocation time TB1 or TB2 is greater than the limit times TD1 and TD2, in step S15. When it is determined that the first or second reciprocation time TB1 or TB2 is less than the limit times TD1 and TD2, it may be determined if one of the first and second reciprocation time reaches preset times TE1 and TE2, in step S16. The preset times TE1 and TE2 may be times set in the controller 510 by a designer to be used as a reference for determining a predetermined amount of the dust accumulated in the dust collection device 200.

The preset times TE1 and TE2 may be obtained in accordance with repeated tests performed by the designer and varied in accordance with a volume of the vacuum cleaner. In addition, the preset times TE1 and TE2 may be less than the reference times TC1 and TC2, which are the reciprocation time of the first compression member 270 when no dust is accumulated in the dust collection device 200.

In this embodiment, when one of the reciprocation times TB1 and TB2 of the first compression member 270 reaches the preset times TE1 and TE2, it may be determined that a predetermined amount of the dust is accumulated. However, the present disclosure may not be limited to this embodiment. For example, it may be determined that the predetermined amount of the dust is accumulated when both of the reciprocation times TB1 and TB2 reach the preset times TE1 and TE2.

When it is determined that at least one of the reciprocation times TB1 and TB2 is greater than the preset times TE1 and TE2, the process may be returned to step S15 to repeat the above-described process. When at least one of the first and second reciprocation times TB1 and TB2 reaches the preset times TE1 and TE2, the controller 510 may determine if a number of times that one of the first or second reciprocation time TB1 or TB2 reaches the preset times TE1 and TE2 continuously reaches a predetermined number N of times (for example, 3 times), in step S17.

In this way, it may be accurately determined that an amount of the dust stored in the dust collection device 200 is greater than a predetermined amount. Further, an error that may be caused by the first compression member 270 which cannot normally operate due to foreign objects may be prevented. The abnormal rotation of the first compression member 270 means a case in which the first compression member 270 rotates toward the second side of the second compression member 280 in a state in which the first compression member 270 cannot rotate toward the first side of the second compression member due to foreign objects clogging the space between the first compression member 270 and the dust collection body 210.

That is, in this embodiment, the malfunction of the first compression member 270 may include a case in which the rotational speed of the first compression member is reduced due to foreign objects clogging the space between the first compression member 270 and the dust collection body 210 and a case in which a rotation direction change of the first compression member 270 is abnormally performed.

In step S17, when it is determined that the number of times is less than the predetermined number of times, the process may be returned to step S15. When it is determined that the number of times reaches the predetermined number of times, a dust collection device empty signal may be displayed, in step S17.

In this embodiment, the empty signal may be displayed on the dust amount display 45 or by a signal comprising repeatedly turning on/off the LEDs provided on the dust amount display sections 45*a*. Alternatively, the empty signal may be a sound generated by a speaker provided on the vacuum cleaner.

Next, the controller 510 may stop the operation of the suction motor 550, in step S20, and the operation of the compression motor 570, in step S20. The reason for forcedly stopping the operation of the suction motor 550 is to prevent the dust suction efficiency from being deteriorated when the amount of the dust stored in the dust collection device 200 is greater than a predetermined amount and to prevent the suction motor 550 from being overloaded. In step S15, when it is determined that at least one of the first and second reciprocation times TB1 and TB2 of the first compression member 270 is greater than the limit times TD1 and TD2, the controller 510 may determine that the compression member 270 malfunctions. The controller 510 may transmit a malfunction signal of the first compression member 270 to the display 530, so that the malfunction display 595 may display the malfunction signal of the first compression member 270, in step S19. Next, the controller 510 may stop the operation of the suction motor 550 and the operation of the compression motor 570, in step S21.

As described above, according to this embodiment, the amount of the dust stored in the dust collection unit 200 and the device empty timing may be displayed, and thus, the user convenience may be improved. Further, since the malfunction signal of the first compression member may be displayed and the compression motor may stop operating, overload of the compression motor may be prevented, and thus, reliability of the product may be improved.

Figure 22:
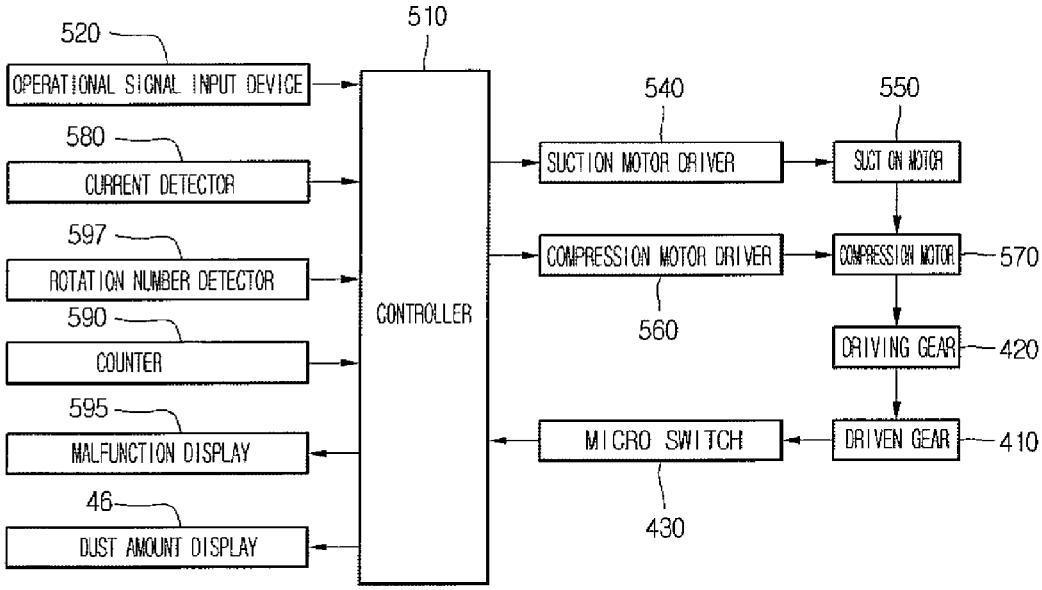
FIG. 22 is a block diagram illustrating a control structure of a vacuum cleaner according to another embodiment.

FIG. 22 is a block diagram of a control structure of a vacuum cleaner according to another embodiment. This embodiment is substantially the same as the previous embodiment, except for a dust amount determining method. Therefore, the following will describe only the features of this embodiment.

Referring to FIG. 22, the vacuum cleaner of this embodiment may further include a rotation detector 597 that detects a number of rotations of the compression motor 570. The rotation detector 597 may detect a number of first reciprocations, each taken when the first compression member 270 rotates clockwise from the reference position and is returned to the reference position, and a number of second reciprocations, each taken when the first compression member 270 rotates counterclockwise from the reference position and is returned to the reference position. That is, in this embodiment, a rotation range of the first compression member 270 may be determined by measuring the number of rotations of the compression motor 570.

The controller 510 may determine the amount of the dust with reference to the number of the first reciprocation rotations and the number of the second reciprocation rotations to display a current dust amount on the dust amount display 46. In addition, when the number of the first or second reciprocating rotations reaches a reference reciprocating rotation number, the controller 510 may display an empty signal.

Figure 23:
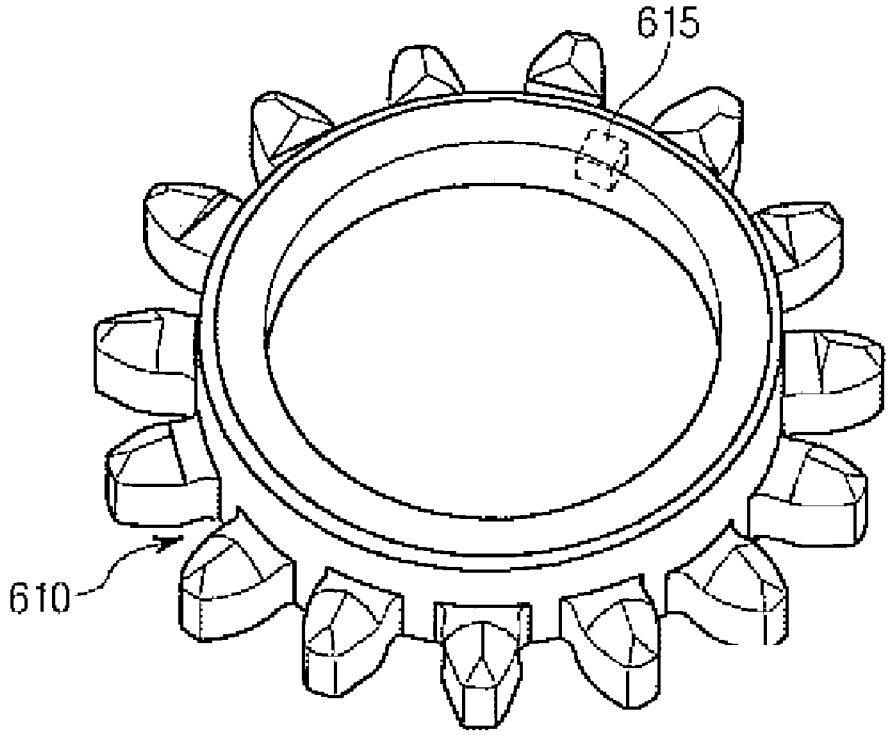
FIG. 23 is a perspective view of a driven gear according to another embodiment.
Figure 24:
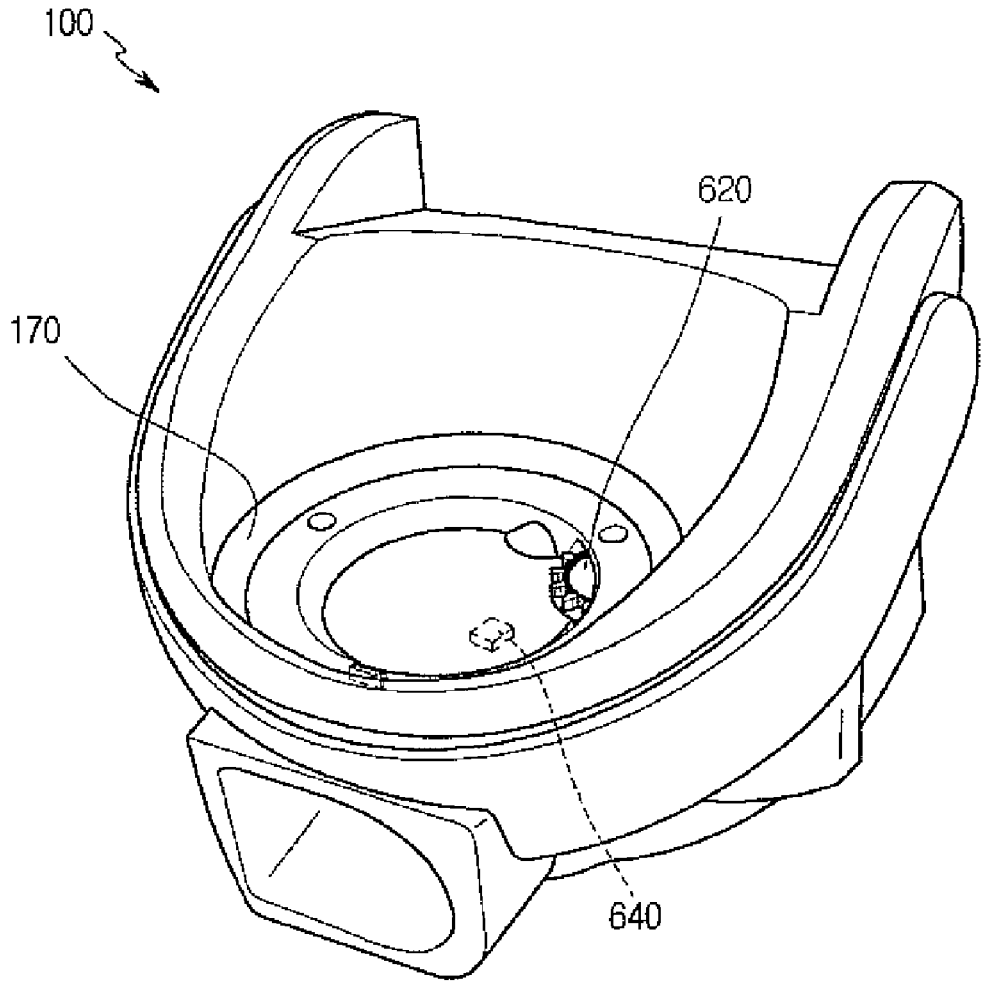
FIG. 24 is a perspective view of a dust collection device mounting portion according to another embodiment.

FIG. 23 is a perspective view of a driven gear according to another embodiment. FIG. 24 is a perspective view of a dust collection device mounting portion according to another embodiment. This embodiment is identical to the embodiment of FIG. 1, except for the reference position identifying device. Therefore, the following will describe only the features of this embodiment.

Referring to FIGS. 23 and 24, a magnetic member 615 may be provided on a lower edge of a driven gear 610. A magnetism detector 640 that detects magnetism generated by the magnetic member 615 may be provided inside the dust collection device mounting portion 170. A hall sensor may be used as the magnetism detector 640.

In order for the magnetism detector 640 to effectively detect the magnetism generated by the magnetic member 615, the magnetism detector 640 may be disposed right under a trace drawn by the magnetic member 615 when the dust collection device 200 is mounted on the dust collection device mounting portion 170 and the driven gear 610 rotates.

Therefore, when the magnetic member 615 is disposed right above the magnetism detector 640 during the rotation of the driven gear 610, the magnetism detector 640 may detect the magnetism of the magnetic member 415, and thus, the reference position of the driven gear 410 may be identified.

Alternatively, in order to identify the reference position of the first compression member 270, an infrared sensor may be used. The infrared sensor may be provided on the terminal described in the embodiment of FIG. 1 and exposed to the dust collection device mounting portion.

Alternatively, a photo sensor may also be used. In this case, a brightness of an identification groove 415 of the driven gear 410 may be different from that of the contact rib 413 so that a position of the identification groove 415 of the driven gear 410 may be detected by the photo sensor, and thus, the reference position of the first compressing member 270 may be determined.

Figure 25:
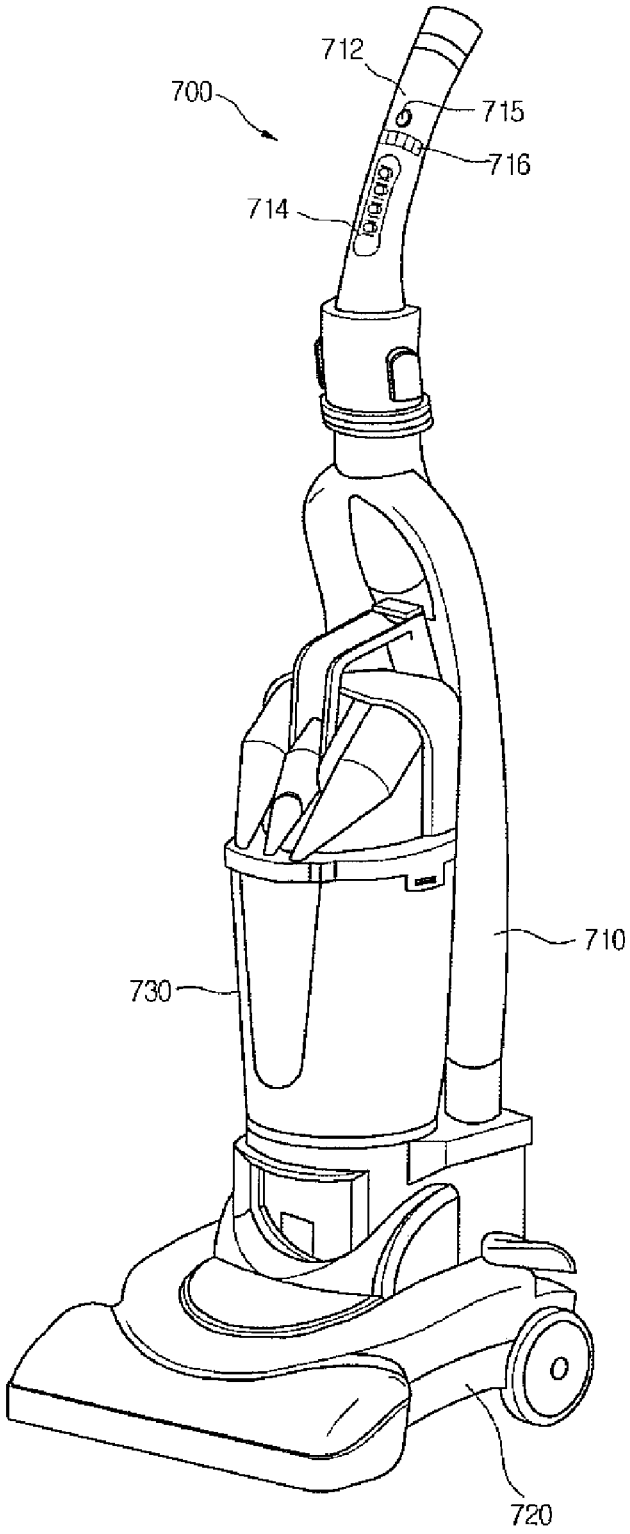
FIG. 25 is a front, perspective view of a vacuum cleaner according to another embodiment.

FIG. 25 is a front, perspective view of a vacuum cleaner according to another embodiment. This embodiment is substantially identical to the embodiment of FIG. 1, except for a type of vacuum cleaner. Therefore, the following will describe only the features of this embodiment.

Referring to FIG. 25, in this embodiment, an upright type vacuum cleaner is proposed. In more detail, the upright type vacuum cleaner 700 may include a suction nozzle 720 that sucks in air containing dust while moving along a floor, a main body 710 rotatably coupled to the suction nozzle 720 and provided with a suction device therein, and a dust collection device 730 selectively mounted on the main body 710.

In more detail, a handle 712 may be formed on a top of the main body 710. A manipulation button 714, a mode selection device 615 that selects an operation mode of the compression motor, and a dust amount display device 716 that displays an amount of the dust stored in the dust collection device 730 may be formed on the handle 712. Therefore, a user may easily control operation of the suction device and the compression motor when he/she graphs the handle 712 and performs cleaning work by moving the main body 710 and the suction nozzle 720.

Figure 26:
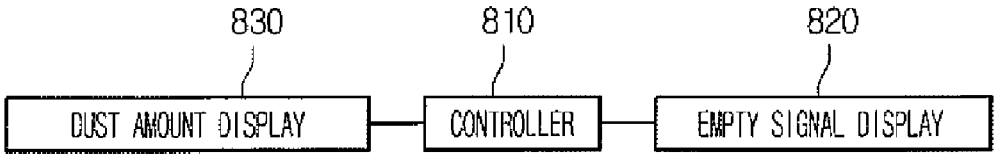
FIG. 26 is a block diagram of a control structure of a vacuum cleaner according to another embodiment.
Figure 27:
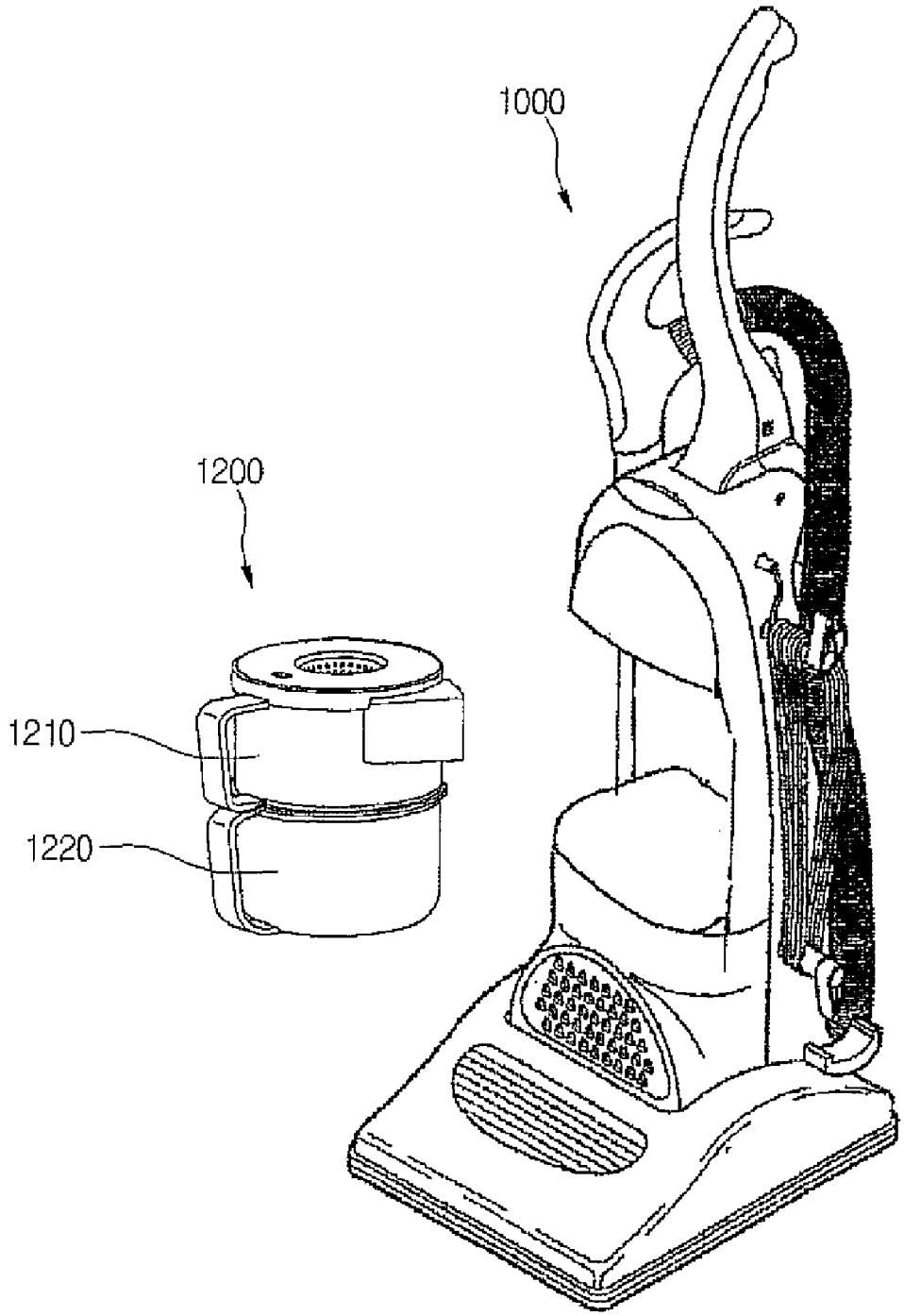
FIG. 27 is a front, perspective view of an upright vacuum according to an embodiment.

FIG. 26 is a block diagram illustrating a control structure of a vacuum cleaner according to another embodiment. This embodiment is substantially identical to the embodiment of FIG. 1, except that the empty signal is separately displayed from the dust amount. Therefore, the following will describe only the features of this embodiment.

Referring to FIG. 26, the vacuum cleaner of this embodiment may include a dust amount display 830 that displays an amount of the dust stored in the dust collection device, an empty signal display 830 that displays a dust dumping signal, and a controller 810 that controls operation of the dust amount display 830 and the empty signal display 820. A display region of the dust amount display 830 that displays the amount of dust may be expanded, or a color of an illuminated LED may be altered.

The empty signal display 820 may provide a visual signal or an audio signal. For example, the empty signal display 820 may comprise of a buzzer circuit or a speaker.

The malfunction display of the first compression member may be separately displayed on a malfunction display or on the empty signal display 820. When the malfunction signal of the first compression signal is displayed on the empty signal display 820, the malfunction signal may be differently set from the empty signal.

Any of the embodiments disclosed herein may be employed in an upright vacuum cleaner, such as the vacuum cleaner 1000 shown in FIG. 20. Further, the dust separator 1210 may be contained within the dust collector body 1220 or the dust separator 1210 may be separately provided from the dust collector body 1220. More detailed explanations of upright vacuum cleaners are provided in U.S. Pat. Nos. 6,922,868 and 7,462,210, which are hereby incorporated by reference.

Embodiments disclosed herein provide a vacuum cleaner that may increase a dust collection volume by compressing dust stored in a dust collection device, and a method of controlling the vacuum cleaner. Embodiments also provide a vacuum cleaner that may effectively operate a compression motor in accordance with an amount of dust stored in a dust collection device, and a method of controlling the vacuum cleaner.

Embodiments also provide a vacuum cleaner that may allow a user to easily identify an amount of dust stored in a dust collection device, and a method of controlling the vacuum cleaner. Embodiments also provide a vacuum cleaner that may allow a user to easily identify malfunction of a compressing member that compresses dust, and a method of controlling the vacuum cleaner.

In accordance with an embodiment, there is provided a vacuum cleaner that may include a cleaner main body, in which a suction motor that generates a suction force is disposed; a dust collection device detachably mounted on the cleaner main body that defines a dust storing portion; a compression member that compresses dust stored in the dust storing portion; a compression motor that drives the compression member; a mode selection device that selects an operational mode of the compression motor; and a controller that controls operation of the compression motor in accordance with the selected mode.

In accordance with another embodiment, there is provided a vacuum cleaner that may include a cleaner main body, in which a suction motor that generates a suction force is disposed; a dust collection device detachably mounted on the cleaner main body that defines a dust storing portion; at least one compression member that compresses dust stored in the dust storing portion; a driver or driving device that drives the compression member; a controller that determines if the compression member malfunctions; and a signal display that displays a malfunction signal of the compression member.

In accordance with still another embodiment, there is provided a method of controlling a vacuum cleaner that may include storing dust in a dust storing portion by operating a suction motor; measuring an operation time of the suction motor; and operating a compression motor to drive a compression member that compresses the dust stored in the dust storing portion when an operation time of the suction motor is greater than a preset time.

According to embodiments, since dust stored in the dust collection device may be compressed by the compressing member, an amount of the dust that may be stored in the dust collection device may be maximized. In addition, as the dust collection amount of the dust collection device may be maximized, there is no need to frequently empty the dust collection device.

Further, since the dust may be maintained in a compressed state in the dust collection device, scattering of the dust may be prevented when the dust collection device is emptied. Also, because the amount of dust collected in the dust collection device may be visible outside of the vacuum cleaner via a display, a user may easily check the amount of dust.

In addition, when a predetermined amount of dust is collected in the dust collection device, an unit empty signal may be displayed, and thus, a user may easily identify when to empty the dust from the dust collection device. Additionally, when the suction motor operates, the compression motor begins operating after a predetermined period of time has elapsed, so that needless operation of the compression motor may be reduced during the initial operation of the suction motor.

In addition, since the operational mode of the compression motor may be selected, the compression motor may be effectively operated in accordance with an amount of the dust stored in the dust collection device. Further, since a malfunction signal of the first compression member may be displayed and the compression motor may stop operating, overload of the compression motor may be prevented, and thus, a reliability of the product may be improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a main body, in which a suction motor that generates a suction force is disposed;

a dust collection device detachably mounted on the main body that defines a dust storing portion;

at least one compression member that compresses dust stored in the dust storing portion;

a compression motor that drives the at least one compression member;

a power transmission device configured to transmit a driving force of the compression motor to the at least one compression member;

a mode selection device that selects an operational mode of the compression motor; and a controller that controls operation of the compression motor in accordance with the selected mode.

2. The vacuum cleaner according to claim 1, wherein the compression motor operates after a predetermined period of time has elapsed after the suction motor begins operating.

3. The vacuum cleaner according to claim 1, wherein the operational mode of the compression motor includes a first operational mode, in which the compression motor continuously operates, and a second operational mode, in which the compression motor operates at predetermined intervals.

4. The vacuum cleaner according to claim 3, wherein the at least one compression member comprises a first compression member, which is rotatable, and a second compression member comprising a stationary member that is formed in the dust storing portion and compresses the dust in association with the first compression member, wherein the first compression member is stopped for a predetermined period of time at a position adjacent to the second compression member in the second operational mode.

5. The vacuum cleaner according to claim 1, further comprising a dust amount display that displays a current amount of dust compressed in the dust storing portion.

6. The vacuum cleaner according to claim 5, wherein the amount of dust stored in the dust storing portion is determined in accordance with a moving range of the at least one compression member.

7. The vacuum cleaner according to claim 6, wherein the moving range of the at least one compression member is determined in accordance with a moving time of the at least one compression member or a number of rotations of the at least one compression member.

8. The vacuum cleaner according to claim 5, wherein, when the amount of dust compressed in the dust storing portion is greater than a reference amount, an empty signal is displayed.

9. The vacuum cleaner according to claim 1, further comprising a malfunction display that displays a malfunction signal if the at least one compression member malfunctions.

10. The vacuum cleaner according to claim 1, wherein the driver comprises a compression motor.

11. A vacuum cleaner, comprising:

a main body, in which a suction motor that generates a suction force is disposed;

a dust collection device detachably mounted on the main body that defines a dust storing portion;

at least one compression member that compresses dust stored in the dust storing portion;

a driver that drives the at least one compression member;

a power transmission device configured to transmit a driving force of the driver to the at least one compression member;

a controller that determines if the at least one compression member malfunctions; and a signal display that displays a malfunction signal if the at least one compression member malfunctions.

12. The vacuum cleaner according to claim 11, further comprising a micro switch that is selectively turned on and off in accordance with rotation of the at least one compression member, and a counter that detects an on/off time of the micro switch.

13. The vacuum cleaner according to claim 11, wherein the at least one compression member compresses the dust while reciprocally rotating with reference to a reference position and a malfunction of the at least one compression member is determined by comparing reciprocation rotating times of the at least one compression member with limit times.

14. The vacuum cleaner according to claim 13, wherein the reference position is a position when the micro switch is turned on or off.

15. The vacuum cleaner according to claim 11, wherein the driver stops operating when the at least one compression member malfunctions.

16. The vacuum cleaner according to claim 11, wherein the suction motor stops operating when the at least one compression member malfunctions.

17. The vacuum cleaner according to claim 11, further comprising a dust amount display that displays an amount of dust compressed in the dust collection device, wherein the controller determines the amount of dust with reference to a moving range of the at least one compression member.

18. A method of controlling a vacuum cleaner, the method comprising:

storing dust in a dust storing portion by operation of a suction motor;

measuring an operation time of the suction motor; and operating a compression motor to drive at least one compression member that compresses the dust stored in the dust storing portion when an operation time of the suction motor is greater than a preset time, wherein when the suction motor stops operating, the compression motor stops operating.

19. The method according to claim 18, wherein the compression motor rotates in opposite directions and continuously operates.

20. The method according to claim 18, wherein the compression motor operates for a predetermined period of time.

* * * * *